US008790097B2

(12) United States Patent
Yokoyama et al.

(10) Patent No.: US 8,790,097 B2
(45) Date of Patent: Jul. 29, 2014

(54) REFRIGERANT COMPRESSOR AND HEAT PUMP APPARATUS

(75) Inventors: Tetsuhide Yokoyama, Tokyo (JP); Toshihide Koda, Tokyo (JP); Shin Sekiya, Tokyo (JP); Kei Sasaki, Tokyo (JP); Raito Kawamura, Tokyo (JP); Taro Kato, Tokyo (JP); Atsuyoshi Fukaya, Tokyo (JP); Takeshi Fushiki, Tokyo (JP); Hideaki Maeyama, Tokyo (JP); Masao Tani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 291 days.

(21) Appl. No.: 13/377,665

(22) PCT Filed: May 24, 2010

(86) PCT No.: PCT/JP2010/058719

§ 371 (c)(1),
(2), (4) Date: Dec. 12, 2011

(87) PCT Pub. No.: WO2010/143521

PCT Pub. Date: Dec. 16, 2010

(65) Prior Publication Data

US 2012/0085118 A1 Apr. 12, 2012

(30) Foreign Application Priority Data

Jun. 11, 2009 (JP) ..... 2009-139786

(51) Int. Cl.

| | |
|---|---|
| ***F01C 1/30*** | (2006.01) |
| ***F01C 11/00*** | (2006.01) |
| ***F03C 2/00*** | (2006.01) |
| ***F03C 4/00*** | (2006.01) |
| ***F04C 2/00*** | (2006.01) |
| ***F04C 11/00*** | (2006.01) |
| ***F04C 13/00*** | (2006.01) |
| ***F04C 23/00*** | (2006.01) |

(52) U.S. Cl.
USPC ..... 418/5; 418/7; 418/11

(58) Field of Classification Search
USPC ..... 418/5, 7, 11
See application file for complete search history.

(56) References Cited

U.S. PATENT DOCUMENTS 5,087,170 A 2/1992 Kousokabe et al.
5,242,280 A 9/1993 Fujio (Continued)

FOREIGN PATENT DOCUMENTS

CN 1749572 A 3/2006
CN 1955475 A 5/2007

(Continued)

OTHER PUBLICATIONS

Japanese Office Action Issued May 14, 2013 in Patent Application No. 2011-518394 (with English translation).

(Continued)

*Primary Examiner* — Thomas Denion
*Assistant Examiner* — Dapinder Singh
(74) *Attorney, Agent, or Firm* — Oblon, Spivak, McClelland, Maier & Neustadt, L.L.P.

(57) ABSTRACT

A refrigerant compressor that enhances compressor efficiency by both reducing an amplitude of pressure pulsations and reducing pressure losses in a discharge muffler space into which is discharged a refrigerant compressed at a compression unit. A low-stage discharge muffler space is formed in the shape of a ring around a drive shaft. In the low-stage discharge muffler space, a discharge port rear guide is provided in the proximity of a discharge port through which is discharged the refrigerant compressed by a low-stage compression unit. The discharge port rear guide is provided at a flow path in one direction out of two flow paths from the discharge port to a communication port in different directions around the drive shaft, and prevents the refrigerant from flowing in that direction, thereby causing the refrigerant to circulate in a forward direction in the ring-shaped discharge muffler space.

22 Claims, 22 Drawing Sheets

(56) References Cited

U.S. PATENT DOCUMENTS

| | | | | |
|---|---|---|---|---|
| 6,210,130 | B1 | 4/2001 | Kakuda et al. | |
| 6,652,238 | B2 | 11/2003 | Kajiwara et al. | |
| 6,732,542 | B2 | 5/2004 | Yamasaki et al. | |
| 6,807,821 | B2 | 10/2004 | Narney, II | |
| 7,611,341 | B2 | 11/2009 | Byun et al. | |
| 7,914,267 | B2 * | 3/2011 | Sato et al. | 418/3 |
| 8,342,825 | B2 | 1/2013 | Byun et al. | |
| 8,398,386 | B2 | 3/2013 | Han et al. | |
| 2003/0068236 | A1 * | 4/2003 | Tadano et al. | 417/312 |
| 2004/0151603 | A1 * | 8/2004 | Tadano et al. | 417/312 |
| 2004/0154329 | A1 * | 8/2004 | Tadano et al. | 62/277 |
| 2004/0165998 | A1 * | 8/2004 | Tadano et al. | 417/312 |
| 2004/0165999 | A1 * | 8/2004 | Tadano et al. | 417/312 |
| 2004/0241012 | A1 | 12/2004 | Kim et al. | |
| 2006/0056987 | A1 | 3/2006 | Seok et al. | |
| 2006/0168994 | A1 * | 8/2006 | Tadano et al. | 62/470 |
| 2008/0008608 | A1 * | 1/2008 | Tadano et al. | 417/410.3 |
| 2008/0075609 | A1 * | 3/2008 | Tadano et al. | 417/410.3 |
| 2008/0236184 | A1 | 10/2008 | Morozumi et al. | |
| 2009/0090579 | A1 | 4/2009 | Nishida et al. | |
| 2009/0180912 | A1 * | 7/2009 | Morozumi et al. | 418/229 |
| 2010/0111737 | A1 * | 5/2010 | Higashi et al. | 418/11 |
| 2010/0143172 | A1 * | 6/2010 | Sato et al. | 418/5 |

FOREIGN PATENT DOCUMENTS

| | | | |
|---|---|---|---|
| CN | 1959116 | A | 5/2007 |
| CN | 101153600 | A | 4/2008 |
| JP | 58-53892 | | 4/1983 |
| JP | 59-66662 | | 4/1984 |
| JP | 60-171988 | | 11/1985 |
| JP | 63-7292 | | 1/1988 |
| JP | 63-138189 | | 6/1988 |
| JP | 2-69091 | | 5/1990 |
| JP | 2-294591 | | 12/1990 |
| JP | 4-134196 | | 5/1992 |
| JP | 4-159490 | | 6/1992 |
| JP | 4-203488 | | 7/1992 |
| JP | 4-342896 | | 11/1992 |
| JP | 5-133368 | | 5/1993 |
| JP | 5-195976 | | 8/1993 |
| JP | 5-195976 | A | 8/1993 |
| JP | 5-312166 | | 11/1993 |
| JP | 5-312166 | A | 11/1993 |
| JP | 7-208363 | | 8/1995 |
| JP | 7-208363 | A | 8/1995 |
| JP | 7-247972 | | 9/1995 |
| JP | 11-166489 | | 6/1999 |
| JP | 2000-9072 | | 1/2000 |
| JP | 2000-9072 | A | 1/2000 |
| JP | 2000-73974 | | 3/2000 |
| JP | 2005-509787 | | 4/2005 |
| JP | 2006-83841 | | 3/2006 |
| JP | 2006-83841 | A | 3/2006 |
| JP | 2007-113542 | | 5/2007 |
| JP | 2007-113542 | A | 5/2007 |
| JP | 2007-120354 | | 5/2007 |
| JP | 2007-120354 | A | 5/2007 |
| JP | 2007-178042 | | 7/2007 |
| JP | 2007-263440 | | 10/2007 |
| JP | 2008-38697 | | 2/2008 |
| JP | 2008-96072 | | 4/2008 |
| JP | 2008-248865 | | 10/2008 |
| JP | 2008-274877 | | 11/2008 |
| JP | 2009-2297 | | 1/2009 |
| JP | 2009-85570 | | 4/2009 |
| JP | 2009-85570 | A | 4/2009 |
| JP | 2010-48089 | | 3/2010 |
| KR | 2003-0001175 | A | 1/2006 |

OTHER PUBLICATIONS

Japanese Office Action Issued May 14, 2013 in Patent Application No. 2011-518395 (with English translation).

Japanese Office Action Issued May 14, 2013 in Patent Application No. 2011-518396 (with English translation).

Extended European Search Report Issued May 10, 2013 in Patent Application No. 10786052.0.

Extended European Search Report Issued May 10, 2013 in Patent Application No. 10786054.6.

U.S. Appl. No. 13/377,678, filed Dec. 12, 2011, Yokoyama, et al.

U.S. Appl. No. 13/381,031, filed Dec. 27, 2011, Yokoyama, et al.

International Search Report issued Jul. 6, 2010 in patent application No. PCT/JP2010/058719.

International Search Report issued Jun. 29, 2010 in patent application No. PCT/JP2010/058720.

International Search Report issued Jun. 29, 2010 in patent application No. PCT/JP2010/058721.

The Japan Society of Fluid Mechanics, "Fluid Mechanics Handbook", May 15, 1998, pp. 437-445 (with handwritten English translation).

The Japan Society of Mechanical Engineers, "Hydraulic Losses in Pipes and Ducts", JSME Data Book, Aug. 20, 1987, pp. 76-85 (with handwritten English translation).

Takesuke Fujimoto, "Fluid Mechanics", published by Yokendo, Apr. 20, 1985, p. 136-137, 142-147 and 164-173.

Office Action dated Dec. 10, 2013 issued in co-pending U.S. Appl. No. 13/377,678.

Combined Search Report and Office Action issued Dec. 4, 2013 in Chinese Patent Application No. 201080025518.0 (with English translation of Relevant portions and English Translation of Category of Cited Documents).

* cited by examiner

REFRIGERANT COMPRESSOR AND HEAT PUMP APPARATUS

TECHNICAL FIELD

This invention relates to a refrigerant compressor and a heat pump apparatus using the refrigerant compressor, for example.

BACKGROUND ART

In a refrigeration air-conditioning system such as a refrigerator-freezer, an air conditioner, and a heat pump type water heater, a vapor compression type refrigeration cycle using a rotary compressor is used.

In light of preventing global warming and so on, energy-saving and efficiency-enhancing measures are needed for the vapor compression type refrigeration cycle. As a vapor compression type refrigeration cycle that aims to provide energy-saving and efficiency-enhancing measures, an injection cycle using a two-stage compressor may be pointed out. To encourage increased use of the injection cycle using the two-stage compressor, cost reduction and further enhancement of efficiency are needed.

Further, due to tightening of regulations for reducing the global warming potential (GWP) of refrigerants, consideration is being given to use of a natural refrigerant such as HC (isobutane, propane), a low-GWP refrigerant such as HFO1234fy, and so on.

However, these refrigerants operate at a lower density compared to a chlorofluorocarbon refrigerant conventionally used, so that large pressure losses occur in a compressor. Thus, there are problems when these refrigerants are used. The problems are that the efficiency of the compressor is reduced, and that the capacity of the compressor is increased.

In a prior art refrigerant compressor, when a discharge valve that controls opening/closing of a discharge port opens, a refrigerant compressed at a compression unit is discharged from a cylinder chamber of the compression unit through the discharge port into a discharge muffler space. In the discharge muffler space, pressure pulsations of the refrigerant discharged therein are reduced, and the refrigerant passes through a communication port and a communication flow path and flows into an internal space of a closed shell.

At this time, over-compression (overshoot) losses occur in the cylinder chamber due to pressure losses occurring from the time of discharge from the cylinder chamber until entry into the internal space of the closed shell, and due to pressure pulsations caused by a phase shift between change in cylinder chamber volume and opening/closing of the valve.

In a two-stage compressor, a refrigerant compressed at a low-stage compression unit is discharged into a low-stage discharge muffler space. In the low-stage discharge muffler space, pressure pulsations of the refrigerant discharged therein are reduced, and the refrigerant passes through an interconnecting flow path and flows into a high-stage compression unit. That is, the two-stage compressor is generally configured such that the low-stage compression unit and the high-stage compression unit are connected in series by an interconnecting portion such as the low-stage discharge muffler space and the interconnecting flow path.

At this time, in the prior art two-stage compressor, large intermediate pressure pulsation losses occur due to additional characteristic causes such as (1), (2) and (3) below. The intermediate pressure pulsation losses correspond to a sum of over-compression (overshoot) losses occurring in the cylinder chamber of the low-stage compression unit and under-expansion (undershoot) losses occurring at a cylinder suction portion of the high-stage compression unit.

(1) A difference in the timing of discharging the refrigerant by the low-stage compression unit and the timing of drawing in the refrigerant by the high-stage compression unit causes pressure pulsations at the interconnecting portion, thereby increasing losses due to pressure pulsations in the cylinder chamber.

(2) A difference in the timing of discharging the refrigerant by the low-stage compression unit and the timing of drawing in the refrigerant by the high-stage compression unit causes disruption to a flow of the refrigerant from a discharge port for discharging the refrigerant from the low-stage compression unit into the low-stage muffler space toward a communication port for passing the refrigerant flowing into the interconnecting flow path leading to the high-stage compression unit, thereby increasing pressure losses.

(3) Pressure losses are increased because the interconnecting flow path is narrow and long, or because a connecting port (inlet/outlet) between the interconnecting flow path and a large space causes the flow of the refrigerant to shrink or expand, or because a three-dimensional change occurs in the flow direction of the refrigerant passing through the interconnecting flow path.

Patent Document 1 discusses a two-stage compressor configured such that the volume of an interconnecting portion is greater than the excluded volume of a compression chamber of a high-stage compression unit. In this two-stage compressor, the large-volume interconnecting portion serves as a buffer, thereby reducing pressure pulsations.

Patent Document 2 discusses a two-stage compressor including an intermediate container in which an internal space is divided into two spaces by a partition member.

One of the two spaces is a main flow space which communicates from a refrigerant discharge port of a low-stage compression unit to a refrigerant suction port of a high-stage compression unit. The other space is a reverse main flow space which is not directly connected with the refrigerant discharge port of the low-stage compression unit and the refrigerant suction port of the high-stage compression unit. A refrigerant flow path is provided in the partition member dividing the main flow space and the reverse main flow space, so that the refrigerant passes between the main flow space and the reverse main flow space through the refrigerant flow path.

In this two-stage compressor, the reverse main flow space serves as a buffer container, thereby reducing pressure pulsations in the intermediate container.

FIG. 1-5 of Patent Document 3 shows a cross-sectional view of a prior art commonly used low-stage discharge muffler space. This low-stage discharge muffler space is formed in the shape of a doughnut enclosed by a bearing portion at the inside, enclosed by a cylindrical outer perimeter wall at the outside, and enclosed by a container bottom lid at the bottom. In this low-stage discharge muffler space, equally-spaced bolts and bolt fixing portions are disposed for fixing a bearing portion support member and a cylindrical container lid.

Patent Document 4 discusses a compressor in which a refrigerant compressed at a compression unit is discharged into a discharge muffler space from a discharge port having a discharge valve and a stopper. In this compressor, a blocking member for preventing the refrigerant from going around to the rear side of the stopper is provided between the stopper of the discharge port and a top plate of the discharge muffler space.

Patent Document 5 discusses a compressor in which a discharge valve for opening and closing a discharge port is attached to a bearing portion of a compression mechanism unit, and a valve cover (discharge muffler container) is attached around the bearing portion. In this compressor, a sound-muffling space component portion is formed around the discharge valve integrally with a stopper of the discharge valve so as to form a sound-muffling space.

An object having a blunt side and a sharp side to a flow characteristically has greatly varying resistance coefficients depending on the orientation to the flow.

For example, Non-Patent Document 1 shows the following equation for a resistance coefficient ($C_D$) obtained by making a resistance (D) acting on a three-dimensional object dimensionless by dynamic pressure of a flow and a projected area S of the object at a cross-section perpendicular to the flow.

$$\text{Resistance coefficient}(C_D)=\text{resistance}(D)+\text{dynamic pressure}(\rho u^2/2)+\text{projected area}(S)$$

Non-Patent Document 1 also discusses that resistance coefficients vary for the same hemispherical shape. That is, for example, when a convex side of the hemispherical shape is directed upstream of the flow, the resistance coefficient is 0.42. On the other hand, when the convex side of the hemispherical shape is directed downstream of the flow, the resistance coefficient is 1.17, i.e., approximately tripled. It is also discussed that when a convex side of a hemispherical shell is directed upstream of the flow, the resistance coefficient is 0.38. On the other hand, when the convex side of the hemispherical shell is directed downstream of the flow, the resistance coefficient is 1.42, i.e., approximately quadrupled. It is also discussed that when a convex side of a two-dimensional half-cylindrical shell is directed upstream of the flow, the resistance coefficient is approximately 1.2. On the other hand, when the convex side of the two-dimensional half-cylindrical shell is directed downstream of the flow, the resistance coefficient is 2.3, i.e., approximately doubled. The hemispherical shell refers to a hemispherical shape having a flat face inwardly concaved. The half-cylindrical shell refers to a half-cylindrical shape having a flat face inwardly concaved.

When a resistance (D) is present in a flow path of a width h, the resistance (D) is obtained by a difference between the amounts of momentum integrated at an inlet (I) and an outlet (O) of a flow path inspection face as follows:

$$\text{Resistance}(D)=\int(p_1+\rho_1 u_1^2)dh-\int(p_o+\rho_o u_o^2)dh$$

Assuming that density (ρ) and velocity (u) are constant at the inlet and outlet of the flow path inspection face, the resistance (D) can be expressed as shown below.

$$\text{Resistance}(D)\approx\int(p_1-p_O))dh$$

Further, assuming that a pressure loss (ΔP) occurs in the flow path, the resistance (D) can be expressed as shown below.

$$\text{Resistance}(D)\approx h\times\Delta P$$

Based on the above, it may be considered that the pressure loss (ΔP) occurring in the flow path is approximately proportional to the resistance (D) of an object placed in the flow path.

CITATION LIST

Patent Documents

[Patent Document 1] JP 63-138189A
[Patent Document 2] JP 2007-120354 A
[Patent Document 3] JP 2008-248865 A
[Patent Document 4] JP 7-247972 A
[Patent Document 5] JP 63-7292 U

Non-Patent Documents

[Non-Patent Document 1] The Japan Society of Fluid Mechanics, "Fluid Mechanics Handbook" May 15, 1998, p. 441-445

DISCLOSURE OF INVENTION

Technical Problem

In the two-stage compressor discussed in Patent Document 1, an amplitude of pressure pulsations at the interconnecting portion is reduced by providing a large buffer container in the interconnecting portion.

However, when the large buffer container is provided in the interconnecting portion, expansion/shrinkage occurs in the refrigerant flowing through the interconnecting portion, so that pressure losses are increased. The flowing capability of the refrigerant flowing through the interconnecting portion is also adversely affected, thereby causing a phase lag. Thus, the amplitude of pressure pulsations at the interconnecting portion is reduced, but at the expense of increased pressure losses at the interconnecting portion.

The same situation occurs when the capacity of the low-stage discharge muffler is adjusted in place of providing a buffer container. That is, when the capacity of the low-stage discharge muffler space is reduced, pressure pulsations are increased and compressor efficiency is reduced. When the capacity of the low-stage discharge muffler space is increased, pressure losses are increased and compressor efficiency is reduced.

In the two-stage compressor discussed in Patent Document 2, the reverse main flow space in the intermediate container (low-stage discharge muffler) serves as a buffer container, thereby absorbing pressure pulsations occurring in the intermediate container and enhancing the compressor efficiency. In particular, this method is highly effective at an operating frequency that can be resonantly absorbed by the buffer container.

In actuality, however, the operating conditions of the compressor are wide-ranging, and the compressor efficiency is not enhanced at operating conditions not confirming to design criteria.

For example, suppose that the volume of the main flow space is made small and the area of the refrigerant flow path provided in the partition member is made small so as to be suitable for low-speed operating conditions with a small refrigerant discharge amount. In this case, at high-speed operating conditions with a large refrigerant discharge amount, pressure pulsations develop and pressure losses are increased. Thus, the compressor efficiency is not enhanced.

In the prior art commonly used low-stage discharge muffler space shown in FIG. 1-5 of Patent Document 3, the bolt fixing portion is prominently disposed at the shortest path between the discharge port and the communication port. Thus, the bolt fixing portion prevents a flow of the refrigerant from the discharge port to the communication port, thereby increasing pressure losses.

In a prior art commonly used low-stage discharge muffler space shown in FIG. 8-2 of Patent Document 3, the shortest path between a discharge port and a communication port is partitioned by a partition wall forming part of a low-stage discharge muffler container. Thus, the partition wall prevents a flow of the refrigerant from the discharge port to the communication port, thereby increasing pressure losses.

In the rotary compressor discussed in Patent Document 4, the blocking member is provided so as to prevent the refrigerant discharged from the discharge port from going around to the rear side of the stopper. As a result, the flow can be enhanced and pressure losses can be reduced locally to a certain degree.

Generally, however, the lift amount of the discharge valve is smaller than the length of the discharge valve, and the stopper is disposed at a very gentle inclination angle, almost parallel to the face where the discharge valve is formed. On the other hand, the refrigerant discharged from the discharge port spreads horizontally in all directions. Thus, the flow direction of the refrigerant cannot be determined simply be providing the discharge valve and the stopper.

Further, in Patent Document 4, the shape of the discharge muffler space and the position of the communication port are not specified. For this reason, the blocking member does not necessarily function to guide a flow from the discharge port to the communication port, which is important for a flow in the discharge muffler space, or to guide an overall flow in the discharge muffler space. Thus, it is not highly effective in reducing pressure losses and enhancing the compressor efficiency.

In the rotary compressor discussed in Patent Document 5, the sound-muffling member integrally formed with the stopper is provided so as to form the sound-muffling space. As a result, pressure pulsations occurring in the discharge muffler space can be reduced, and low noise operation can be realized. It is also expected that pressure pulsations in the cylinder chamber can be reduced, and the compressor efficiency can be enhanced.

However, providing the sound-muffling member so as to form the sound-muffling space is not effective in guiding a flow from the discharge port to the communication port, which is important to a flow in the discharge muffler space, or guiding an overall flow in the discharge muffler space. As a result, compressor losses may be increased, and the compressor efficiency may be adversely affected.

It is an object of this invention to enhance the compressor efficiency by reducing both the amplitude of pressure pulsations and pressure losses in a discharge muffler space into which is discharged a refrigerant compressed at a compression unit.

Solution to Problem

A refrigerant compressor according to this invention includes, for example a compression unit that is driven by rotation of a drive shaft passing through a center portion, the compression unit drawing a refrigerant into a cylinder chamber and compressing the refrigerant in the cylinder chamber, a discharge muffler that defines, as a ring-shaped space around the drive shaft, a discharge muffler space into which the refrigerant compressed in the cylinder chamber is discharged through a discharge port provided in the compression unit, and from which the refrigerant flows out to a different space through a communication port provided at a predetermined position, and a discharge port rear guide that is positioned closer to the discharge port than to the communication port in a circulation flow path in a reverse direction out of two circulation flow paths from the discharge port to the communication port in different directions, namely a forward direction and the reverse direction, around the drive shaft in the ring-shaped discharge muffler space defined by the discharge muffler, the discharge port rear guide preventing the refrigerant discharged through the discharge port from flowing in the reverse direction.

In the refrigerant compressor, the discharge port rear guide prevents the refrigerant from flowing in the reverse direction, thereby causing the refrigerant to circulate in the forward direction in the ring-shaped discharge muffler space.

Advantageous Effects of Invention

In a compressor according to this invention, a refrigerant discharged from a discharge port can be prevented from flowing in a reverse direction by a discharge port rear guide. As a result, the refrigerant discharged from the discharge port is facilitated to circulate in a forward direction in a ring-shaped discharge muffler space. By circulating the refrigerant in a fixed direction in the ring-shaped discharge muffler space, pressure pulsations can be reduced. By circulating the refrigerant in the fixed direction in the ring-shaped discharge muffler space, the refrigerant is induced to flow orderly, so that pressure losses can be reduced. Thus, in a multi-stage compressor according to this invention, compressor efficiency can be enhanced.

DESCRIPTION OF EMBODIMENTS

First Embodiment

The following description concerns a two-stage compressor (two-stage rotary compressor) having two compression units (compression mechanisms), namely a low-stage compression unit and a high-stage compression unit, as an example of a multi-stage compressor. The multi-stage compressor may have three or more compression units (compressor mechanisms).

In the following drawings, an arrow indicates a flow of a refrigerant.

Figure 1:
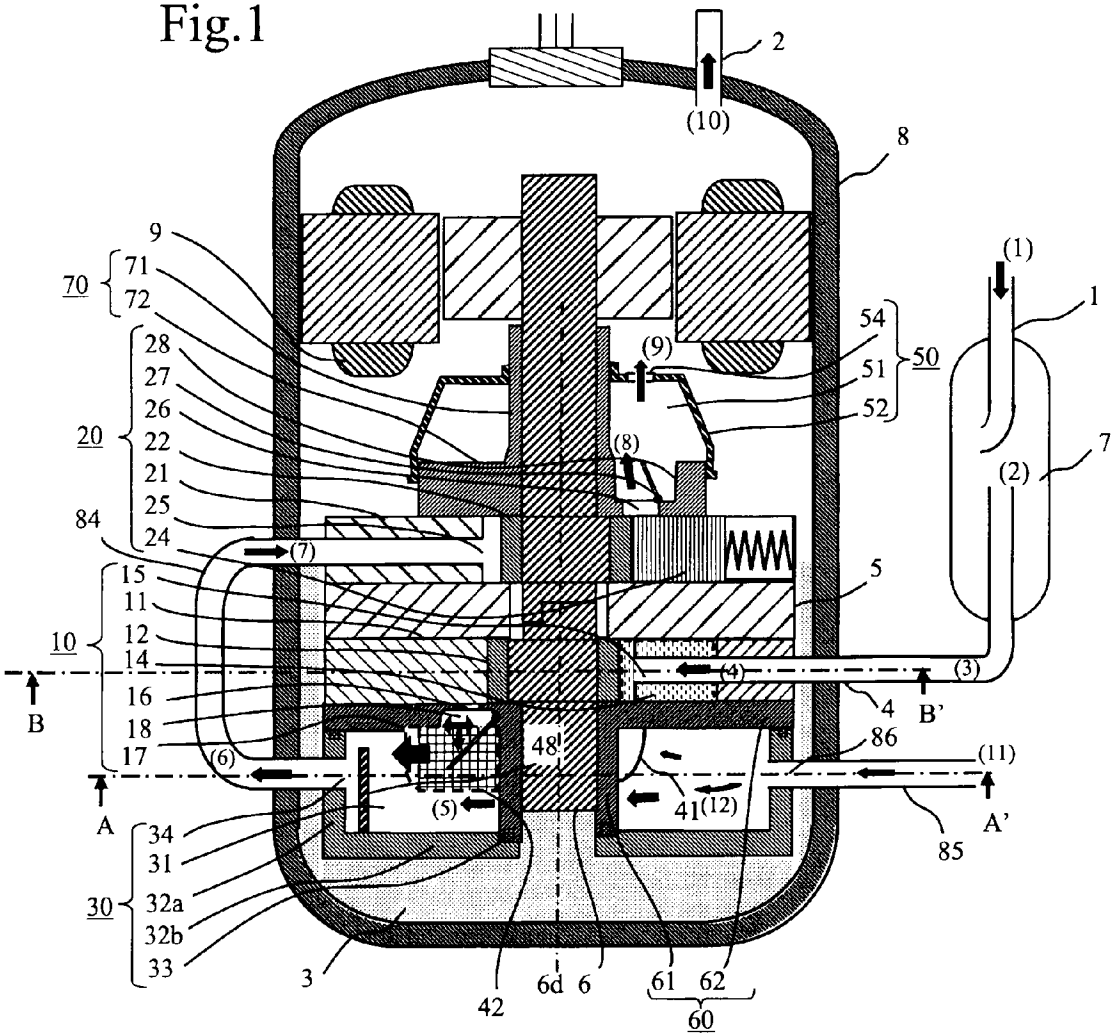
FIG. 1 is a cross-sectional view of an overall configuration of a two-stage compressor according to a first embodiment.

FIG. 1 is a cross-sectional view of a two-stage compressor according to a first embodiment.

The two-stage compressor according to the first embodiment includes, in a closed shell 8, a low-stage compression unit 10, a high-stage compression unit 20, a low-stage discharge muffler 30, a high-stage discharge muffler 50, a lower support member 60, an upper support member 70, a lubricating oil storage unit 3, an intermediate partition plate 5, a drive shaft 6, and a motor unit 9.

The low-stage discharge muffler 30, the lower support member 60, the low-stage compression unit 10, the intermediate partition plate 5, the high-stage compression unit 20, the upper support member 70, the high-stage discharge muffler 50, and the motor unit 9 are stacked in order from a lower side in an axial direction of the drive shaft 6. In the closed shell 8, the lubricating oil storage unit 3 is provided at the bottom in the axial direction of the drive shaft 6.

The low-stage compression unit 10 and the high-stage compression unit 20 include cylinders 11 and 21, respectively. Further, the low-stage compression unit 10 and the high-stage compression unit 20 include, in the cylinders 11 and 21, cylinder chambers 11*a* and 21*a*, rolling pistons 12 and 22, and vanes 14 and 24, respectively. The cylinders 11 and 21 are provided with cylinder suction ports 15 and 25, respectively.

The low-stage compression unit 10 is stacked such that the cylinder 11 is positioned between the lower support member 60 and the intermediate partition plate 5.

The high-stage compression unit 20 is stacked such that the cylinder 21 is positioned between the upper support member 70 and the intermediate partition plate 5.

The low-stage discharge muffler 30 includes a low-stage discharge muffler sealing portion 33 and a container 32 having a container outer wall 32*a* and a container bottom lid 32*b*.

The low-stage discharge muffler 30 defines a low-stage discharge muffler space 31 enclosed by the container 32 and the lower support member 60. A clearance between the container 32 and the lower support member 60 is sealed by the low-stage discharge muffler sealing portion 33 so as to prevent leakage of a refrigerant at an intermediate pressure that has entered the low-stage discharge muffler space 31. The container outer wall 32*a* is provided with a communication port 34 that communicates to the high-stage compression unit 20 through an interconnecting pipe 84.

An injection pipe 85 is attached to the container outer wall 32*a*. An injection refrigerant flowing through the injection pipe 85 is injected into the low-stage discharge muffler space 31 from an injection port 86.

The high-stage discharge muffler 50 includes a container 52.

The high-stage discharge muffler 50 defines a high-stage discharge muffler space 51 enclosed by the container 52 and the upper support member 70. The container 52 is provided with a communication port 54 that communicates to an internal space of the closed shell 8.

The lower support member 60 includes a lower bearing portion 61 and a discharge-port-side wall 62.

The lower bearing portion 61 is cylindrically-shaped and supports the drive shaft 6. The discharge-port-side wall 62 defines the low-stage discharge muffler space 31 and supports the low-stage compression unit 10.

The discharge-port-side wall 62 has formed therein a discharge valve accommodating recessed portion 18 where a discharge port 16 is provided. The discharge port 16 communicates the cylinder chamber (compression space) 11*a* defined by the cylinder 11 of the low-stage compression unit 10 with the low-stage discharge muffler space 31 defined by the low-stage discharge muffler 30. A discharge valve 17 (on/off valve) that opens and closes the discharge port 16 is attached to the discharge valve accommodating recessed portion 18.

Likewise, the upper support member 70 includes an upper bearing portion 71 and a discharge-port-side wall 72.

The upper bearing portion 71 is cylindrically-shaped and supports the drive shaft 6. The discharge-port-side wall 72 defines the high-stage discharge muffler space 51 and supports the high-stage compression unit 20.

The discharge-port-side wall 72 has formed therein a discharge valve accommodating recessed portion 28 where a discharge port 26 is provided. The discharge port 26 communicates the cylinder chamber (compression space) 21*a* defined by the cylinder 21 of the high-stage compression unit 20 with the high-stage discharge muffler space 51 defined by the high-stage discharge muffler 50. A discharge valve 27 (on/off valve) that opens and closes the discharge port 26 is attached to the discharge valve accommodating recessed portion 28.

The two-stage compressor according to the first embodiment includes, external to the closed shell 8, a compressor suction pipe 1, a suction muffler connecting pipe 4, a suction muffler 7, and the interconnecting pipe 84.

The suction muffler 7 draws in a refrigerant from an external refrigerant circuit through the compressor suction pipe 1. The suction muffler 7 then separates the refrigerant into a gas refrigerant and a liquid refrigerant. The separated gas refrigerant is drawn into the low-stage compression unit 10 through the suction muffler connecting pipe 4.

The interconnecting pipe 84 defines an interconnecting flow path that connects the communication port 34 of the low-stage discharge muffler 30 and the cylinder chamber 21*a* of the high-stage compression unit 20.

A flow of the refrigerant will be described.

First the refrigerant at a low pressure passes through the compressor suction pipe 1 ((1) of FIG. 1) and flows into the suction muffler 7 ((2) of FIG. 1). The refrigerant that has flowed into the suction muffler 7 is separated into the gas refrigerant and the liquid refrigerant in the suction muffler 7. After being separated into the gas refrigerant and the liquid refrigerant, the gas refrigerant passes through the suction muffler connecting pipe 4 ((3) of FIG. 1) and is drawn into the cylinder chamber 11*a* of the low-stage compression unit 10 ((4) of FIG. 1).

The refrigerant drawn into the cylinder chamber 11*a* is compressed to an intermediate pressure at the low-stage compression unit 10. The refrigerant compressed to the intermediate pressure is discharged into the low-stage discharge muffler space 31 from the discharge port 16 ((5) of FIG. 1). The refrigerant discharged into the low-stage discharge muffler space 31 passes through the communication port 34 and the interconnecting flow path ((6) of FIG. 1), and is drawn into the cylinder 21 of the high-stage compression unit 20 ((7) of FIG. 1).

Next the refrigerant drawn into the cylinder 21 is compressed to a high pressure at the high-stage compression unit 20. The refrigerant compressed to the high pressure is discharged from the discharge port 26 into the high-stage discharge muffler space 51 ((8) of FIG. 1). Then, the refrigerant discharged into the high-stage discharge muffler space 51 is discharged through the communication port 54 into the internal space of the closed shell 8 ((9) of FIG. 1). The refrigerant discharged into the internal space of the closed shell 8 passes through a clearance in the motor unit 9 at an upper side of the compression unit, then passes through a compressor discharge pipe 2 fixed to the closed shell 8, and is discharged to the external refrigerant circuit ((10) of FIG. 1).

During an injection operation, an injection refrigerant flowing through the injection pipe 85 ((11) of FIG. 1) is injected from the injection port 86 into the low-stage discharge muffler space 31 ((12) of FIG. 1). In the low-stage discharge muffler space 31, the injection refrigerant ((12) of FIG. 1) is mixed with the refrigerant discharged from the discharge port 16 into the low-stage discharge muffler space 31 ((5) of FIG. 1). The mixed refrigerant is drawn into the cylinder 21 of the high-stage compression unit 20 ((6) (7) of FIG. 1), and is compressed to the high pressure and is discharged outwardly ((8) (9) (10) of FIG. 1), as described above.

When the refrigerant at the high pressure passes through the internal space of the closed shell 8, the refrigerant and lubricating oil are separated. The separated lubricating oil is stored in the lubricating oil storage unit 3 at the bottom of the closed shell 8, and is picked up by a rotary pump attached to a lower portion of the drive shaft 6 so as to be supplied to a sliding portion and a sealing portion of each compression unit.

As described above, the refrigerant compressed to the high pressure at the high-stage compression unit 20 and discharged into the high-stage discharge muffler space 51 is discharged into the internal space of the closed shell 8. Thus, the closed shell 8 has an internal pressure equal to a discharge pressure of the high-stage compression unit 20. Hence, the compressor shown in FIG. 1 is of a high-pressure shell type.

Compression operations of the low-stage compression unit 10 and the high-stage compression unit 20 will be described.

Figure 2:
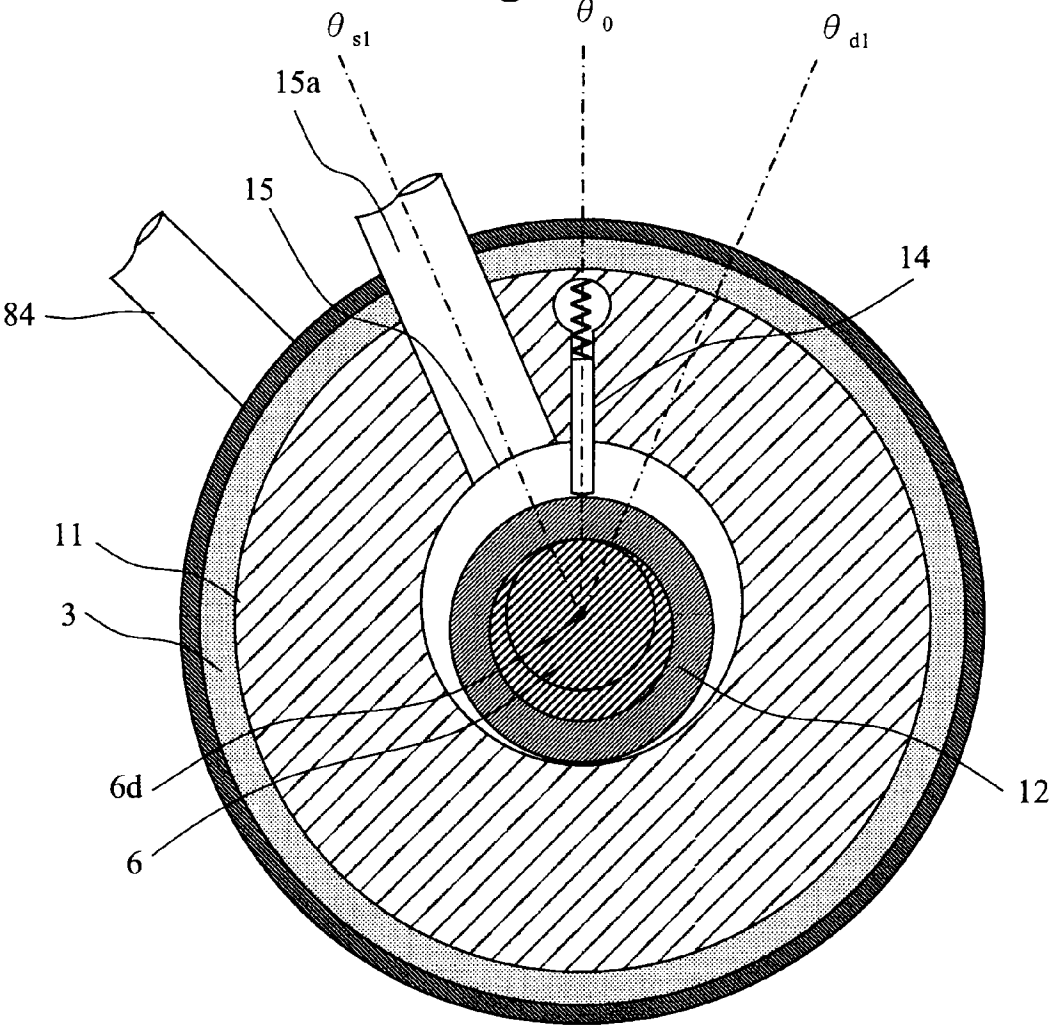
FIG. 2 is a cross-sectional view of the two-stage compressor according to the first embodiment taken along line B-B' of FIG. 1.

FIG. 2 is a cross-sectional view of the two-stage compressor according to the first embodiment taken along line B-B' of FIG. 1.

The motor unit 9 rotates the drive shaft 6 on an axis 6*d* so as to drive the compression units 10 and 20. Rotation of the drive shaft 6 causes the rolling pistons 12 and 22 of the cylinder chambers 11*a* and 21*a* to eccentrically rotate counterclockwise in the low-stage compression unit 10 and the high-stage compression unit 20, respectively.

As shown in FIG. 2, in the low-stage compression unit 10, the rolling piston 12 compresses the refrigerant by rotating such that an eccentric position to minimize a clearance between the rolling piston 12 and the inner wall of the cylinder 11 moves, in order, from a rotation reference phase $\theta_0$ through a phase $\theta_{S1}$ at the cylinder suction port to a phase $\theta_{d1}$ at the low-stage discharge port. The rotation reference phase is defined as the position of the vane 14 that partitions the cylinder chamber 11*a* into a compression side and a suction side. That is, the rolling piston 12 compresses the refrigerant by rotating counterclockwise from the rotation reference phase $\theta_0$ through the phase $\theta_{S1}$ at the cylinder suction port 15 to the phase $\theta_{d1}$ at the discharge port 16.

Likewise, in the high-stage compression unit 20, the rolling piston 22 compresses the refrigerant by rotating such that the eccentric position moves counterclockwise from the rotation reference phase $\theta_0$ through a phase $\theta_{S2}$ at the cylinder suction port 25 to a phase $\theta_{d2}$ at the discharge port 26.

The low-stage discharge muffler space 31 will be described.

Figure 3:
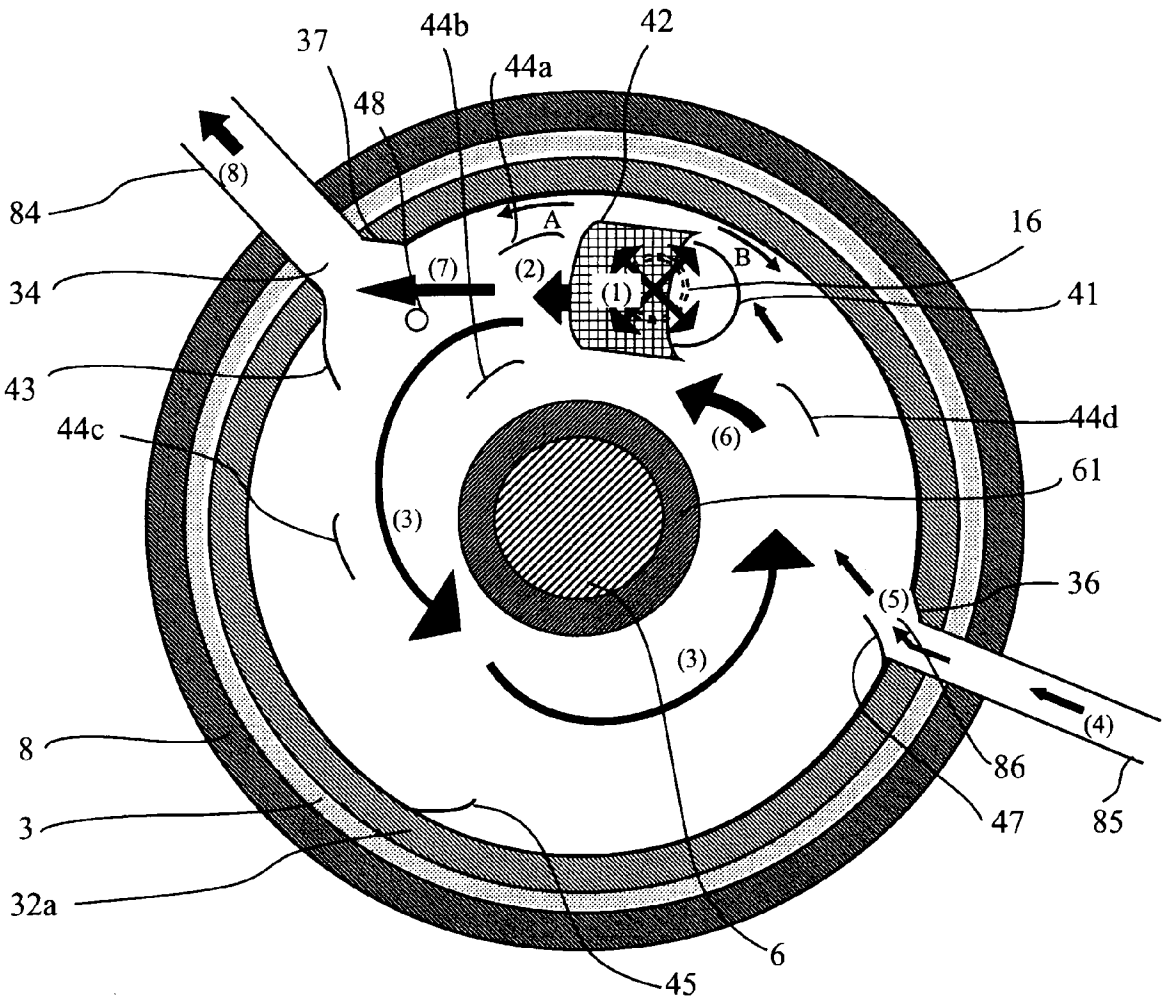
FIG. 3 is a cross-sectional view of the two-stage compressor according to the first embodiment taken along line A-A' of FIG. 1.

FIG. 3 is a cross-sectional view of the two-stage compressor according to the first embodiment taken along line A-A' of FIG. 1.

As described above, the low-stage discharge muffler space 31 is enclosed and defined by the container 32 having the container outer wall 32*a* and the container bottom lid 32*b*, and the lower support member 60 having the lower bearing portion 61 and the discharge-port-side wall 62. The clearance between the container 32 and the lower support member 60 is sealed by the sealing portion 33, and thus the low-stage discharge muffler space 31 is separated from the lubricating oil storage unit 3 at a high pressure within the closed shell 8.

As shown in FIG. 3, the low-stage discharge muffler space 31 is formed in the shape of a ring (doughnut) around the drive shaft 6 such that, in a cross-section perpendicular to the axial direction of the drive shaft 6, an inner peripheral wall is defined by the lower bearing portion 61 and an outer peripheral wall is defined by the container outer wall 32*a*. That is, the low-stage discharge muffler space 31 is formed in the shape of a ring (loop) around the drive shaft 6.

The refrigerant compressed at the low-stage compression unit 10 is discharged from the discharged port 16 into the low-stage discharge muffler space 31 ((1) of FIG. 3). The injection refrigerant is also injected from the injection port 86 into the low-stage discharge muffler space 31 ((5) of FIG. 3). These refrigerants (i) circulate in the ring-shaped low-stage discharge muffler space 31 in a forward direction (direction A of FIG. 3) ((3) of FIG. 3), and (ii) pass through the communication port 34 and the interconnecting pipe 84 and flow into the high-stage compression unit 20 ((7) (8) of FIG. 3).

In order to make the refrigerants entering the low-stage discharge muffler space 31 flow like (i) and (ii) above, the low-stage discharge muffler space 31 includes a discharge port rear guide 41, a discharge port guiding guide 42, a flow control guide 43, guiding guides 44*a*, 44*b*, 44*c*, and 44*d*, a flow control guide 45, an injection port guide 47, and a branch guide 48.

Figure 4:
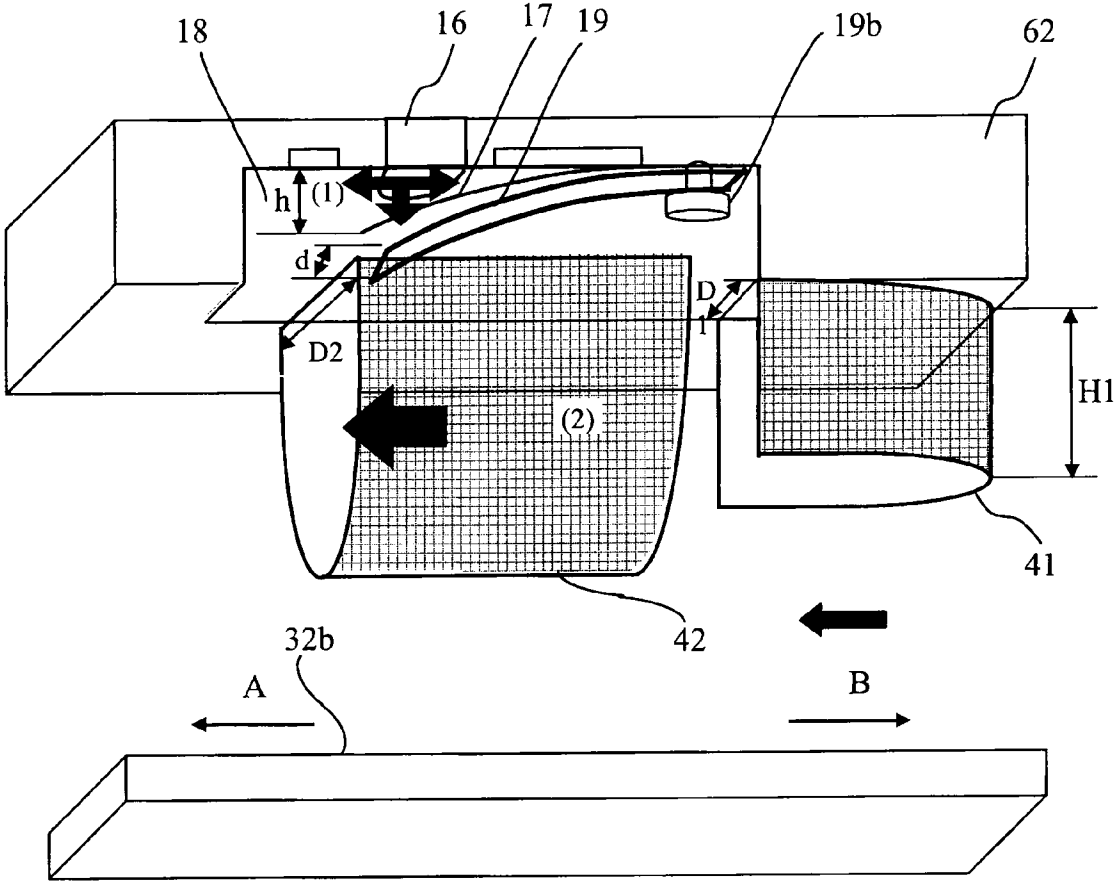
FIG. 4 is a perspective view of a discharge port rear guide 41 and a discharge port guiding guide 42 according to the first embodiment.

Referring to FIGS. 3 and 4, the discharge port rear guide 41 and the discharge port guiding guide 42 will be described.

FIG. 4 is a diagram illustrating the discharge port rear guide 41 and the discharge port guiding guide 42 according to the first embodiment.

The discharge port rear guide 41 is provided in the proximity of the discharge port 16 at a flow path in a reverse direction (at a rear side) out of two flow paths from the discharge port 16 to the communication port 34 in different directions around the shaft, i.e., the forward direction (direction A of FIGS. 3 and 4) and the reverse direction (direction B of FIGS. 3 and 4) in the ring-shaped discharge muffler space. The length of the flow path from the discharge port 16 to the communication port 34 is longer in the reverse direction than in the forward direction.

The discharge port guiding guide 42 is provided so as to cover the discharge port 16 with a clearance therebetween. The discharge port guiding guide 42 has an opening at a side where the discharge port rear guide 41 is provided and an opening at the reverse (communication port) side.

The refrigerant is discharged radially from the discharge port 16 ((1) of FIGS. 3 and 4). However, the refrigerant is prevented by the discharge port rear guide 41 from flowing in a direction toward the discharge port rear guide 41 (direction B of FIGS. 3 and 4). Thus, the refrigerant discharged from the discharge port 16 flows in a direction different from the direction in which the discharge port rear guide 41 is provided.

Further, the flow of the refrigerant is prevented by the discharge port guiding guide 42, so that the refrigerant is controlled to flow in the direction (forward direction, direction A of FIGS. 3 and 4) opposite from the direction in which the discharge port rear guide 41 is provided ((2) of FIGS. 3 and 4).

In this way, the refrigerant discharged from the discharge port 16 is guided to flow in the forward direction by the discharge port rear guide 41 and the discharge port guiding guide 42. The low-stage discharge muffler space 31 is formed in the shape of a ring, so that the refrigerant circulates in the forward direction ((3) of FIG. 3).

It is desirable that the discharge port rear guide 41 prevent the refrigerant discharged from the discharge port 16 from flowing in the reverse direction, and not prevent a flow of the refrigerant circulating in the forward direction. Therefore, the discharge port rear guide 41 is formed in a concave shape at the side of the discharge port 16 (forward direction side) and in a convex shape at the side opposite from the discharge port 16 (reverse direction side). That is, the discharge port rear guide 41 is formed in a blunt shape at the side of the discharge port 16 (forward direction side), and in a sharp shape at the side opposite from the discharge port 16 (reverse direction side). For example, the discharge port rear guide 14 is formed such that a cross-sectional surface thereof perpendicular to the axial direction is U- or V-shaped with the side of the discharge port 16 in a concave shape and the opposite side in a convex shape. For example, when the discharge port rear guide 41 is formed in the shape of a half-cylindrical shell, a relationship between resistance coefficients of the flow paths in the two directions is such that the resistance coefficient in the reverse direction is approximately twice as large as the resistance coefficient in the forward direction. As a result, the refrigerant is made to circulate through the ring-shaped discharge muffler space in the forward direction.

By using, for example, a metal plate with a large number of perforations, such as perforated metal or metallic mesh, as a material for forming the discharge port rear guide 41 and the discharge port guiding guide 42, pressure pulsations of the refrigerant discharged from the discharge port 16 can be reduced. Another advantageous effect is that the refrigerant discharged from the discharge port 16 can be mixed and guided with the refrigerant circulating in the low-stage discharge muffler and the refrigerant injected from the injection port 86.

As shown in FIG. 4, the discharge-port-side wall 62 of the lower support member 60 has formed therein the discharge valve accommodating recessed portion 18 where the discharge port 16 is provided. The discharge valve 17 formed by a thin plate-like elastic body such as a plate spring is attached to the discharge valve accommodating recessed portion 18. A stopper 19 for adjusting (limiting) a lift amount (bending amount) of the discharge valve is attached so as to cover the discharge valve 17. The discharge valve 17 and the stopper 19 are fixed at one end to the discharge valve accommodating recessed portion 18 with a bolt 19*b*.

A difference between the pressure in the cylinder chamber of the low-stage compression unit 10 and the pressure in the low-stage discharge muffler space 31 causes the discharge valve 17 to be lifted, thereby opening and closing the discharge port 16. The refrigerant is thus discharged from the discharge port 16 into the low-stage discharge muffler space 31. That is, a discharge valve mechanism for opening the discharge port 16 is of a reed valve type.

As shown in FIG. 4, the stopper 19 is fixed at one end at the rear side of the discharge port 16, and is formed to be gradually inclined away from the discharge port 16 toward the communication port 34. However, the stopper 19 has a narrow radial width d, and is inclined at a gentle angle nearly parallel to the discharge-port-side wall 62 where the discharge port 16 is formed. Therefore, the stopper 19 provides little interference with a flow in the reverse direction (direction B of FIGS. 3 and 4) of the refrigerant discharged from the discharge port 16.

In contrast, the discharge port rear guide 41 is provided at an angle nearly perpendicular to the discharge-port-side wall 62. In addition, a radial width D1 of the discharge port rear guide 41 and a radial width D2 of the discharge port guiding guide 42 are greater than a diameter of the discharge port 16, a radial width of the discharge valve 17, and the radial width d of the stopper 19. That is, a projected flow path area S1 (=D1×H1) of the discharge port rear guide 41 is greater than a projected flow path area s (=d×h) of the stopper. The projected flow path area S1 of the discharge port rear guide 41 is an area of a figure obtained by rotating the discharge port rear guide 41 with the axis 6*d* as a rotational axis and plotting a trajectory of the discharge port rear guide 41 on a predetermined flat surface across the axis 6*d*. Likewise, the projected flow path area s of the stopper is an area of a figure obtained by rotating the stopper 19 with the axis 6*d* as a rotational axis and plotting a trajectory of the stopper 19 on the predetermined flat surface across the axis 6*d*. Likewise, a projected flow path area of a given object is an area of a figure obtained by rotating the object with the axis 6*d* as a rotational axis and plotting a trajectory of the object on the predetermined surface across the axis 6*d*.

The discharge port rear guide 41 and the discharge port guiding guide 42 prevent the refrigerant discharged from the discharge port 16 from flowing in the reverse direction, and facilitate a flow in the forward direction, to a wider extent compared to the stopper 19. Thus, by providing the discharge port rear guide 41 and the discharge port guiding guide 42, the refrigerant discharged from the discharge port 16 can be circulated in the forward direction.

Referring to FIG. 3, the injection port guide 47 will be described.

The injection port guide 47 is provided in the proximity of the injection port 86 at a flow path in the reverse direction out of two flow paths from the injection port 86 to the communication port 34 in different directions around the shaft, i.e., the forward direction (direction A of FIG. 3) and the reverse direction (direction B of FIG. 3). In particular, the injection port guide 47 is provided so as to incline and cover the injection port 86 from the side of the flow path in the reverse direction, and to protrude into the low-stage discharge muffler space 31.

When the refrigerant that has flowed through the injection pipe 85 ((4) of FIG. 3) is injected from the injection port 86, the refrigerant is guided by the injection port guide 47 to flow in the forward direction ((5) of FIG. 3). Then, the refrigerant circulates in the forward direction ((3) of FIG. 3).

To facilitate the refrigerant injected from the injection port 86 to flow in the forward direction, a wall 36 of the injection port 86 at the forward direction side is tapered to be approximately parallel to the injection port guide 47.

Referring to FIG. 3, the flow control guide 43 and the flow control guide 45 will be described.

The flow control guide 43 and the flow control guide 45 are provided on the container outer wall 32*a* that defines an outer periphery of the low-stage discharge muffler space 31, so as to incline and protrude in the forward direction in which the refrigerant is guided to circulate by the discharge port rear guide 41 and so on. In particular, the flow control guide 43 is provided in the proximity of the communication port 34 at a flow path in the reverse direction out of two flow paths from the discharge port 16 to the communication port 34 in different directions around the shaft, i.e., the forward direction (direction A of FIG. 3) and the reverse direction (direction B of FIG. 3). The flow control guide 45 is provided at an approximately intermediate position between the flow control guide 43 and the injection port guide 47 in the forward direction in which the refrigerant circulates.

The flow control guide 43 and the flow control guide 45 prevent the refrigerant from flowing in the reverse direction relative to the circulation direction. The refrigerant tends to flow in the reverse direction relative to the circulation direction when the amount of the refrigerant drawn into the high-stage compression unit 20 is greater than the amount of the refrigerant discharged from the low-stage compression unit 10. However, a flow in the reverse direction can be prevented by the flow control guide 43, the flow control guide 45, and the injection port guide 47 described above.

Referring to FIG. 3, the guiding guides 44*a*, 44*b*, 44*c*, and 44*d* will be described.

The guiding guides 44*a*, 44*b*, 44*c*, and 44*d* are provided between the container outer wall 32*a* that defines the outer periphery of the low-stage discharge muffler space 31 and the lower bearing portion 61 that defines the inner periphery of the low-stage discharge muffler space 31. These guides are formed to be in alignment with the circulation direction of the refrigerant. For example, the guiding guides 44*a*, 44*b*, 44*c*, and 44*d* are airfoil plates positioned in alignment with the circulation direction of the refrigerant.

The guiding guide 44*a* is provided at the flow path in the forward direction from the discharge port 16, and outwardly to the discharge port 16 in the radial direction of the low-stage discharge muffler space 31. The guiding guide 44*b* is provided at the flow path in the forward direction from the discharge port 16, and inwardly to the discharge port 16 in the radial direction of the low-stage discharge muffler space 31. The guiding guides 44*a* and 44*b*, in particular, cause the refrigerant discharged from the discharge port 16 and flowing in the forward direction to be guided to the circulation direction.

The guiding guide 44*c* is provided at an approximately intermediate position between the flow control guide 43 and the flow control guide 45 in the circulation direction of the refrigerant. The guiding guide 44*c* guides the refrigerant circulating in the low-stage discharge muffler space 31 to the circulation direction so that the refrigerant flows orderly.

The guiding guide 44*d* is provided at an approximately intermediate position between the injection port guide 47 and the guiding guide 44*a* in the circulation direction of the refrigerant. The guiding guide 44*d*, in particular, causes the refrigerant flowing in the forward direction with the aid of the injection port guide 47 to be guided to the circulation direction ((6) of FIG. 3).

Referring to FIG. 3, the branch guide 48 will be explained.

The branch guide 48 is provided between the position of the communication port 34 and the center position of the low-stage discharge muffler space 31 at a cross-section perpendicular to the axial direction of the drive shaft 6 (the axis 6*d* of the drive shaft 6). The branch guide 48 is formed in the shape of a rod (cylinder) extending in the axial direction of the drive shaft 6 (see FIG. 1).

The branch guide 48 induces the refrigerant to branch into the circulation direction ((3) of FIG. 3) in which the refrigerant circulates and a discharge direction ((7) of FIG. 3) in which the refrigerant flows out from the communication port 34.

A wall 37 at the reverse direction side of the communication port 34 is tapered so that the refrigerant branched to the discharge direction is facilitated to flow from the communication port 34 into the interconnecting pipe 84.

That is, the refrigerant discharged radially from the discharge port 16 into the low-stage discharge muffler space 31 ((1) of FIGS. 3 and 4) is guided by the discharge port rear guide 41 and the discharge port guiding guide 42 to flow in the forward direction ((2) of FIGS. 3 and 4). Then, the refrigerant discharged from the discharge port 16 is induced by the flow control guide 43, the guiding guides 44*a*, 44*b*, 44*c*, and 44*d*, and the flow control guide 45 to circulate in the low-stage discharge muffler space 31 ((3) of FIG. 3).

The refrigerant injected from the injection port 86 ((4) of FIG. 3) is guided by the injection port guide 47 to flow in the forward direction ((5) of FIG. 3). Then, the refrigerant injected from the injection port 86 is induced by the flow control guide 43, the guiding guides 44*a*, 44*b*, 44*c*, and 44*d*, and the flow control guide 45 to circulate in the low-stage discharge muffler space 31 ((3) of FIG. 3).

The refrigerant discharged from the discharge port 16, the refrigerant injected from the injection port 86, and the refrigerant circulating in the low-stage discharge muffler space 31 are joined and mixed in the proximity of an outlet of the injection port 86, the guiding guide 44*d*, the discharge port rear guide 41, and so on ((6) etc. of FIG. 3).

The refrigerant flowing through the low-stage discharge muffler space 31 branches into the circulation direction and the discharge direction with the aid of the branch guide 48. The refrigerant flowing in the circulation direction circulates in the low-stage discharge muffler space 31 ((3) of FIG. 3), and the refrigerant flowing in the discharge direction passes through the communication port 34 and the interconnecting pipe 84, and flows into the high-stage compression unit 20 ((7) and (8) of FIG. 3).

Figure 5:
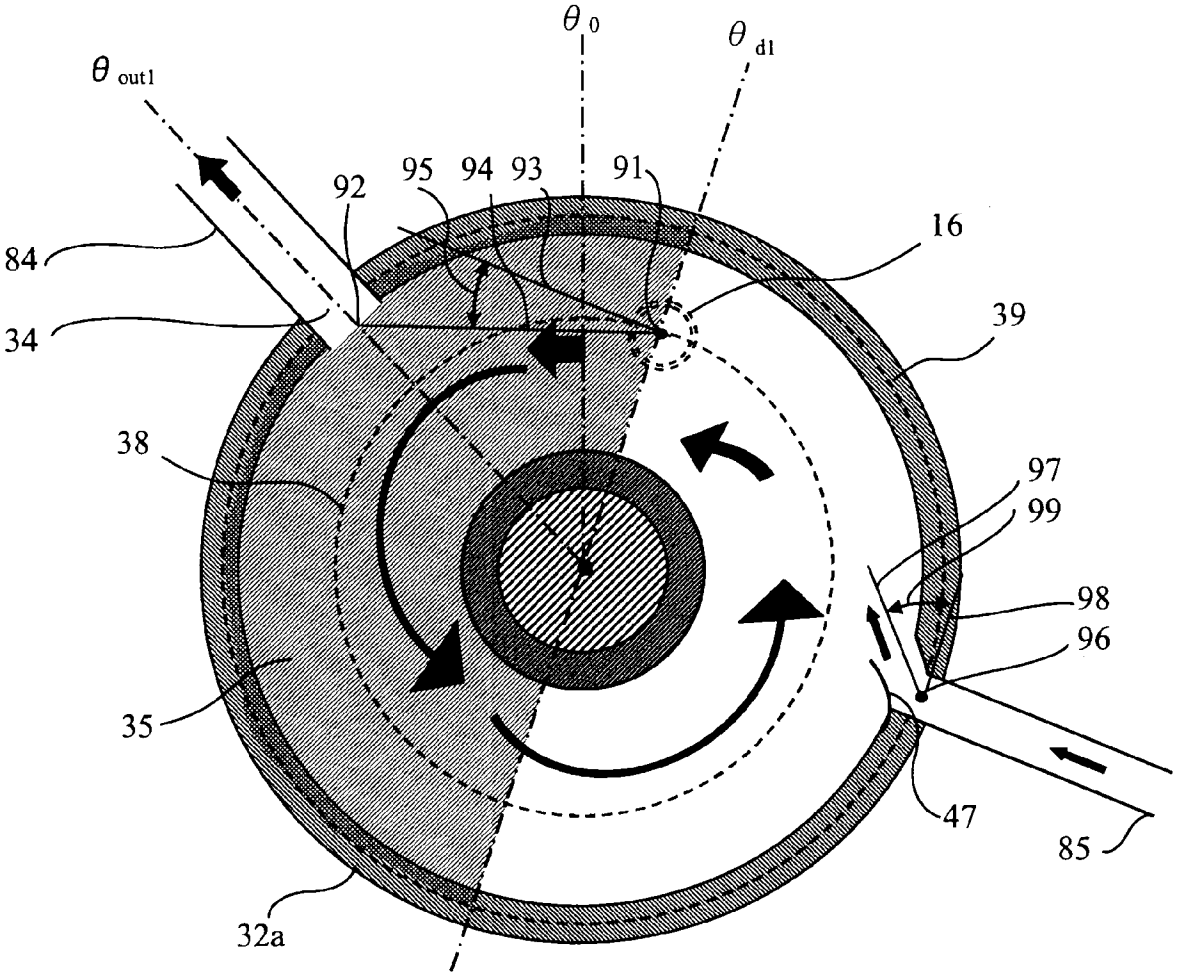
FIG. 5 is a diagram illustrating positionings of a discharge port 16 and a communication port 34 according to the first embodiment, and an inclination of an injection port guide 47 according to the first embodiment.

Referring to FIG. 5, it will be described how the discharge port 16 and the communication port 34 are positioned and how the injection port guide 47 is directed.

FIG. 5 is a diagram illustrating positionings of the discharge port 16 and the communication port 34 according to the first embodiment and an inclination of the injection port guide 47 according to the first embodiment. FIG. 5 shows a simplified cross-sectional view of the two-stage compressor according to the first embodiment taken along A-A' of FIG. 1 with some components omitted.

First the positionings of the discharge port 16 and the communication port 34 will be described.

In FIG. 5, a circle 38 indicated by dashed lines is a circle which is centered on the center position of the low-stage discharge muffler 31 at a cross-section perpendicular to the axial direction of the drive shaft 6 (the axis 6*d* of the drive shaft 6), and which passes through a center position 91 of the discharge port 16. A tangent 93 is a tangent to the circle 38 at the center position 91 of the discharge port 16, and is drawn over the flow path in the forward direction from the discharge port 16 to the communication port 34. A line 94 is a line connecting the center position 91 of the discharge port 16 and a center position 92 of the communication port 34 at the cross-section perpendicular to the axial direction of the drive shaft 6.

The discharge port 16 and the communication port 34 are positioned such that an angle 95 defined by the tangent 93 and the line 94 is not more than 90 degrees. That is, when the discharge port 16 is positioned as shown in FIG. 5, the communication port 34 is positioned within a hatched area 35 of FIG. 5.

The center position of the discharge port and the center position of the connection port coincide with the position of the center of gravity of opening portions provided in the container 32 forming the discharge muffler and the lower support member 60. When the opening portions are two-dimensional, the position of the center of gravity is two-dimensional. When the opening portions are three-dimensional, the position of the center of gravity is three-dimensional.

The discharge port 16 and the communication port 34 are positioned as described above so that a force to draw in the refrigerant by the high-stage compression unit 20, that is, a force to draw the refrigerant into the communication port 34 can be utilized as a force to make the refrigerant flow in the forward direction.

At the cross-section perpendicular to the axial direction of the drive shaft 6, an ideal flow direction of the circulating refrigerant at the center position 91 of the discharge port 16 is a direction indicated by the tangent 93. When the angle 95 defined by this ideal flow direction and the line 94 is not more than 90 degrees, the force to draw the refrigerant into the communication port 34 can be utilized as a force to make the refrigerant flow in the ideal flow direction.

On the other hand, when the angle 95 is greater than 90 degrees, the force to draw the refrigerant into the communication port 34 acts as a force to prevent the refrigerant from flowing in the ideal flow direction.

The discharge port 16 and the communication port 34 may be positioned such that the angle 95 defined by the tangent 93 and the line 94 is not more than 30 degrees. Alternatively, the discharge port 16 and the communication port 34 may be positioned such that the angle 95 defined by the tangent 93 and the line 94 is 0 degrees.

Further, the communication port 34 may be positioned in a range of $\theta_0$ to ($\theta_{d1}$−180 degrees). That is, the communication port 34 may be positioned within the hatched area 35 of FIG. 5 excluding an area between $\theta_{d1}$ and $\theta_0$.

Next the direction of the injection port guide 47 will be described.

In FIG. 5, a circle 39 indicated by dashed lines is a circle which is centered on the center position of the low-stage discharge muffler space 31 at the cross-section perpendicular to the axial direction of the drive shaft 6 (the axis 6*d* of the drive shaft 6), and which passes through a center position 96 of the injection port 86. A tangent 98 is a tangent to the circle 39 at the center position 96 of the injection port 86, and is drawn over the flow path in the forward direction from the injection port 86 to the communication port 34. A line 97 is a line which passes the center position 96 of the discharge port 86 at the cross-section perpendicular to the axial direction of the drive shaft 6, and which is approximately parallel to the inclination of the injection port guide 47.

The injection port guide 47 is inclined such that an angle 99 defined by the tangent 98 and the line 97 is not more than 90 degrees. That is, the injection port guide 47 is provided such that it gradually inclines from the reverse direction side to the forward direction side of the injection port 86 away from the injection port 86.

The injection port guide 47 is positioned as described above so that a force to inject the refrigerant from the injection port 86 can be utilized as a force to make the refrigerant flow in the forward direction.

At the cross-section perpendicular to the axial direction of the drive shaft 6, an ideal flow direction of the circulating refrigerant at the center position 96 of the injection port 86 is a direction indicated by the tangent 98. When the angle 99 defined by this ideal flow direction and the line 97 is not more than 90 degrees, the force to inject the refrigerant from the injection port 86 can be utilized as a force to make the refrigerant flow in the ideal flow direction.

On the other hand, when the angle 99 is greater than 90 degrees, the force to inject the refrigerant from the injection port 86 acts as a force to prevent the refrigerant from flowing in the ideal flow direction.

The injection pipe 85 is generally connected so as to be angled at 90 degrees to the closed shell 8 and the container outer wall 32*a*. That is, the injection pipe 85 is generally connected at 90 degrees to the tangent 98. Even with this arrangement, the force to inject the refrigerant from the injection port 86 can be utilized as the force to make the refrigerant flow in the ideal flow direction. However, by providing the injection port guide 47 and making the angle 99 smaller than 90 degrees, the force to inject the refrigerant from the injection port 86 can be utilized more efficiently as the force to make the refrigerant flow in the ideal flow direction.

As described above, in the two-stage compressor according to the first embodiment, the low-stage discharge muffler space 31 is formed in the shape of a ring and the refrigerant is made to circulate in a fixed direction.

By circulating the refrigerant in the ring-shaped discharge muffler space, a difference between the timing of discharging the refrigerant by the low-stage compression unit and the timing of drawing in the refrigerant by the high-stage compression unit can be adjusted such that pressure pulsations are turned into rotational motion energy instead of pressure losses. As a result, occurrence of pressure pulsations can be prevented.

In the multi-stage compressor according to this invention, the refrigerant is induced to circulate in the ring-shaped discharge muffler space in a fixed direction, so that the refrigerant can be facilitated to flow orderly, and pressure losses can be prevented.

Therefore, in the two-stage compressor according to the first embodiment, compressor efficiency is enhanced.

As shown in FIG. 3, it is desirable that the low-stage discharge muffler space 31 include all of the discharge port rear guide 41, the discharge port guiding guide 42, the flow control guide 43, the guiding guides 44*a*, 44*b*, 44*c*, and 44*d*, the flow control guide 45, the injection port guide 47, a taper on wall 37 at the reverse direction side of the communication port 34, a taper on the wall 36 at the forward direction side of the injection port 86, and the branch guide 48.

Figure 6:
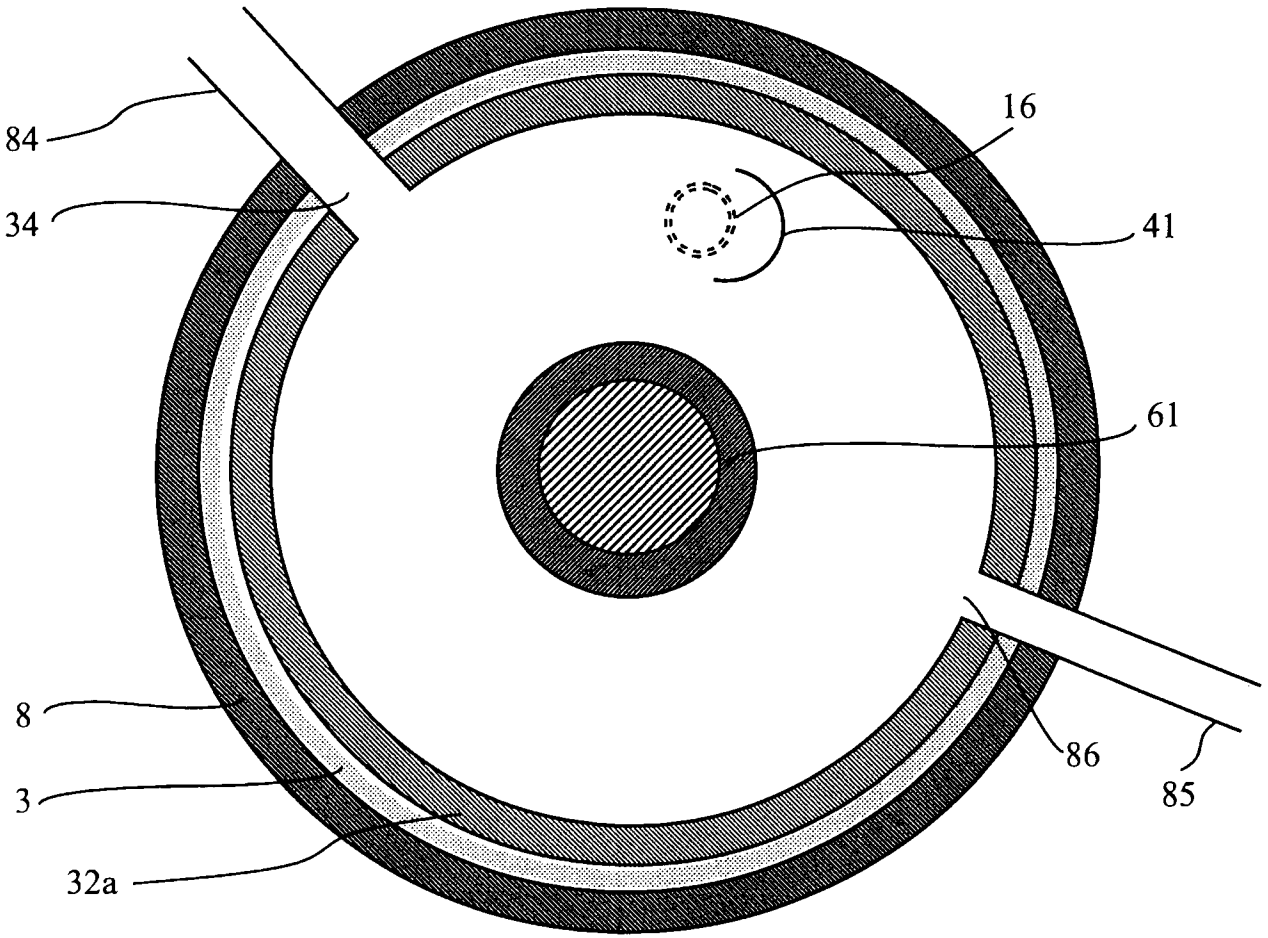
FIG. 6 is a diagram showing an example of a minimum configuration of the two-stage compressor according to the first embodiment.

However, by providing at least the discharge port rear guide 41 as shown in FIG. 6, pressure pulsations can be reduced and pressure losses can be prevented to a certain extent.

Figure 7:
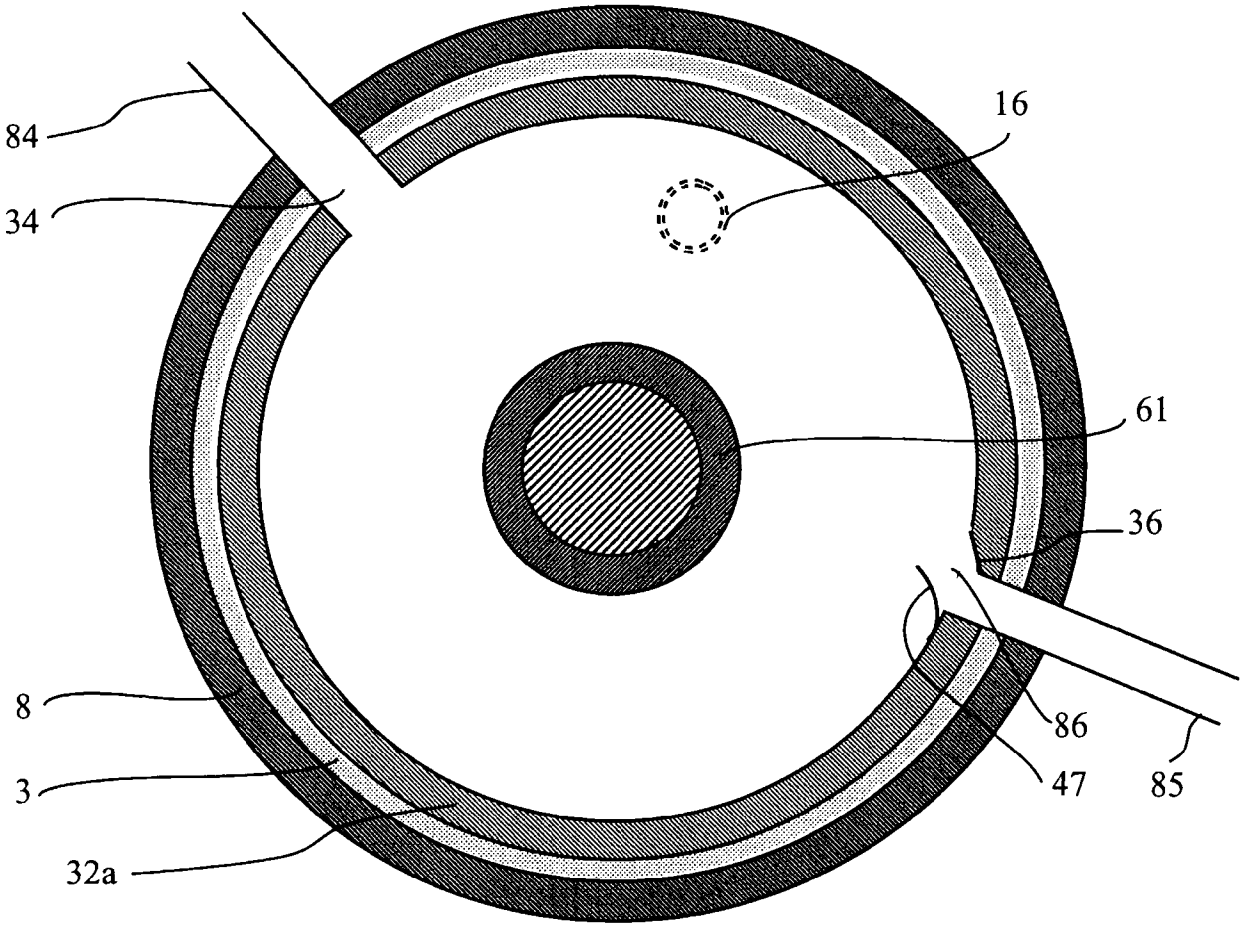
FIG. 7 is a diagram showing an example of a minimum configuration of the two-stage compressor according to the first embodiment.

Likewise, by providing at least the injection port guide 47 as shown in FIG. 7, pressure pulsations can be reduced and pressure losses can be prevented to a certain extent.

Second Embodiment

In a second embodiment, results of experiments on the two-stage compressor described in the first embodiment will be described.

<Experiment 1>

Experiment 1 concerns a relationship between specific compressor efficiency and operating frequency when the refrigerant is not injected.

Figure 8:
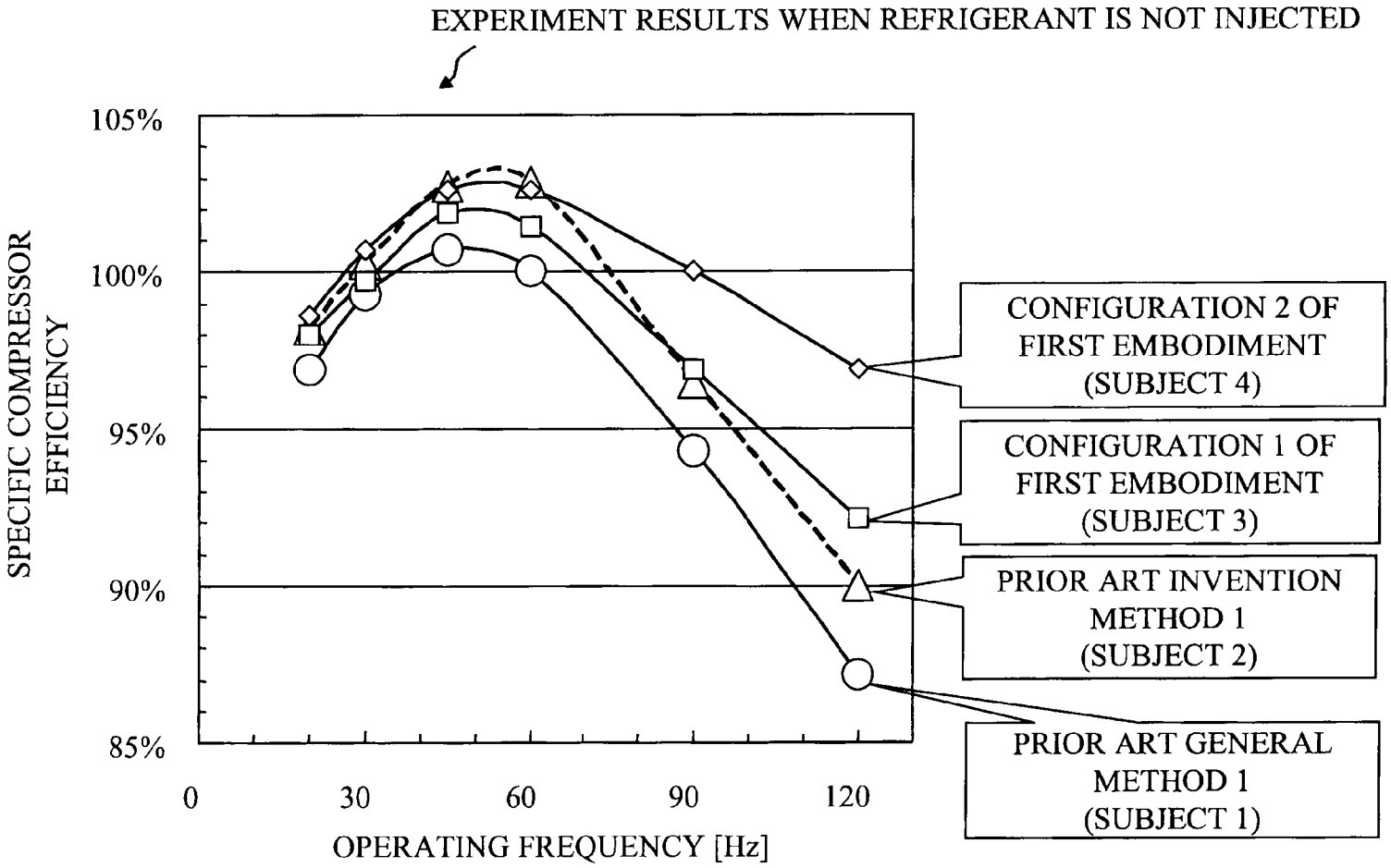
FIG. 8 is a diagram showing a relationship between specific compressor efficiency and operating frequency of the two-stage compressor according to the first embodiment when a refrigerant is not injected (results of Experiment 1)

FIG. 8 is a diagram showing a relationship between the specific compressor efficiency and operating frequency of the two-stage compressor according to the first embodiment when the refrigerant is not injected (results of Experiment 1). In FIG. 8, the specific compressor efficiency is expressed in reference to the compressor efficiency of a prior art general method 1 (Subject 1) at the operating frequency of 60 Hz.

<Conditions of Experiment 1>

An air conditioning compressor was used with an R410A refrigerant at operating conditions equivalent to Ashrae-T conditions: CT/ET=54.4° C./7.2° C., SC=27.8° C. That is, the air conditioning compressor was used with the R410A refrigerant with high pressure=3.4 MPa, low pressure=1 MPa, and compressor suction temperature=35° C.

<Comparison Subjects of Experiment 1>

Compressor efficiencies were compared for the following four types of low-stage discharge muffler configuration. The capacity of the low-stage discharge muffler space 31 was 85 cc in each case.

(Subject 1: Prior Art General Method 1)

Subject 1 is a two-stage compressor without any guide in the low-stage discharge muffler space 31.

(Subject 2: Prior Art Invention Method 1)

Subject 2 is a two-stage compressor in which the low-stage discharge muffler space 31 is divided into two spaces as disclosed in Patent Document 2. A cross-sectional area of a hole that interconnects the two spaces was adjusted to be optimum at the operating frequency of 60 Hz.

(Subject 3: Configuration 1 of the First Embodiment)

Subject 3 is a two-stage compressor in which only the discharge port rear guide 41 and the discharge port guiding guide 42 are provided and other guides are not provided. That is, Subject 3 is a two-stage compressor in which the low-stage discharge muffler space 31 is configured as shown in FIG. 6 and the discharge port guiding guide 42 is further provided.

(Subject 4: Configuration 2 of the First Embodiment)

Subject 4 is a two-stage compressor including all the guides described in the first embodiment. That is, Subject 4 is a two-stage compressor in which the low-stage discharge muffler space 31 is configured as shown in FIG. 3.

<Results of Experiment 1>

(Subject 1: Prior Art General Method 1)

In Subject 1, the best compressor efficiency was obtained at the operating frequency of 45 Hz. The higher the operating frequency, the lower the compression efficiency became. This characteristic is commonly observed when the two-stage compressor has large mechanical and pressure losses.

(Subject 2: Prior Art Invention Method 1)

In Subject 2, the cross-sectional area of the hole interconnecting the two spaces was adjusted to be optimum at the operating frequency of 60 Hz, so that the compressor efficiency at the operating frequency of 60 Hz was the highest among the four methods. At higher operating frequencies, however, the compressor efficiency was higher compared to Subject 1, but the degree of enhancement was small.

(Subject 3: Configuration 1 of the First Embodiment)

In Subject 3, the compressor efficiency was lower compared to Subject 2 when the operating frequency was lower than 80 Hz. However, when the operating frequency was higher than 80 Hz, the compressor efficiency was higher compared to Subject 2.

(Subject 4: Configuration 2 of the First Embodiment)

In Subject 4, the compressor efficiency was equivalent to that of Subject 2 when the operating frequency was lower than 60 Hz. However, when the operating frequency was higher than 60 Hz, the compressor efficiency was higher compared to Subject 2.

<Experiment 2>

Experiment 2 concerns a relationship between specific compressor efficiency and specific injection refrigerant amount when the refrigerant is injected.

Figure 9:
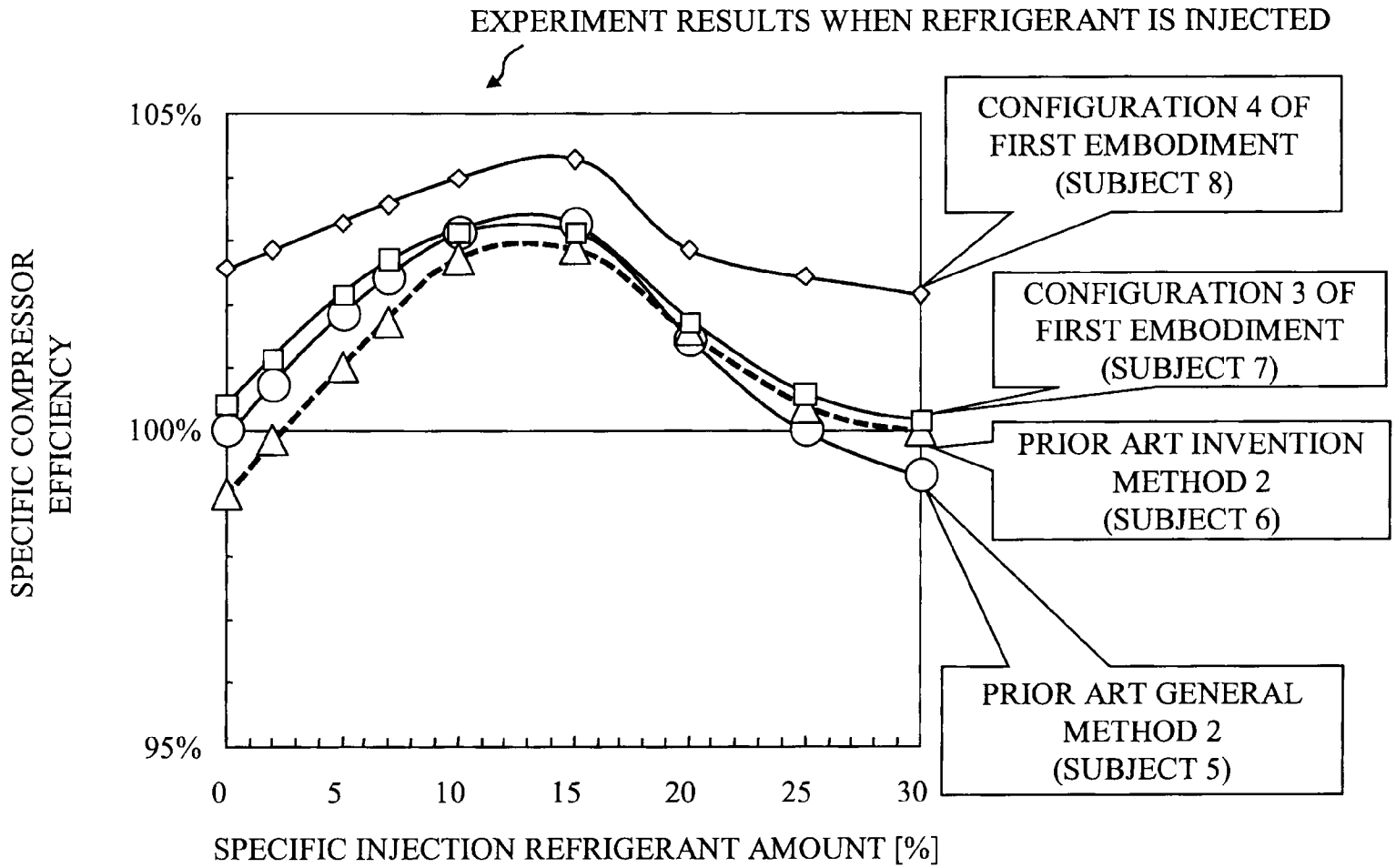
FIG. 9 is a diagram showing a relationship between the specific compressor efficiency and operating frequency of the two-stage compressor according to the first embodiment when the refrigerant is injected (results of Experiment 2)

FIG. 9 is a diagram showing a relationship between the specific compressor efficiency and the specific injection refrigerant amount of the two-stage compressor according to the first embodiment when the refrigerant is injected (results of Experiment 2). In FIG. 9, the specific compressor efficiency is expressed in reference to the compressor efficiency of the prior art general method 2 (Subject 5) when the specific injection refrigerant amount is 0%. The specific injection refrigerant amount is expressed in reference to the amount of the refrigerant drawn into the low-stage compression unit 10. That is, the specific injection refrigerant amount indicates a percentage of the injected refrigerant relative to the amount of the refrigerant drawn into the low-stage compression unit 10.

<Conditions of Experiment 2>

An air conditioning compressor was used with the R410A refrigerant at operating conditions equivalent to Ashrae-T conditions: CT/ET=54.4° C./7.2° C., SC=27.8° C. That is, the air conditioning compressor was used with the R410A refrigerant with high pressure=3.4 MPa, low pressure=1 MPa, and compressor suction temperature=35° C. A refrigerant with a dryness of 0.6 was injected.

<Comparison Subjects of Experiment 2>

Compressor efficiencies were compared for the following four types of low-stage discharge muffler configuration. The capacity of the low-stage discharge muffler space 31 was 85 cc in each case.

(Subject 5: Prior Art General Method 2)

Subject 5 is a two-stage compressor in which no guide is provided in the low-stage discharge muffler space 31, and the injection port 86 for injecting the injection refrigerant is provided at an intermediate position of the interconnecting pipe.

(Subject 6: Prior Art Invention Method 2)

Subject 6 is a two-stage compressor in which the low-stage discharge muffler space 31 is configured as shown in FIG. 8-2 of Patent Document 3, and the injection port 86 for injecting the injection refrigerant is provided in the low-stage discharge muffler space 31.

(Subject 7: Configuration 3 of the First Embodiment)

Subject 7 is a two-stage compressor in which only the injection port guide 47 is provided without any other guide.

That is, Subject 7 is a two-stage compressor in which the low-stage discharge muffler space 31 is configured as shown in FIG. 7.

(Subject 8: Configuration 4 of the First Embodiment)

Subject 8 is a two-stage compressor including all the guides described in the first embodiment. That is, Subject 8 is a two-stage compressor in which the low-stage discharge muffler space 31 is configured as shown in FIG. 3.

<Results of Experiment 2>

(Subject 5: Prior Art General Method 2)

In Subject 5, the compressor efficiency was highest when the specific injection refrigerant amount was 15%. The greater the refrigerant injection amount, the lower the compressor efficiency became.

Generally speaking, in a two-stage compressor, an injection of a refrigerant with a high dryness increases an intermediate pressure. Further, in the two-stage compressor, an injection of a certain amount of the refrigerant achieves the optimum intermediate pressure ((low pressure×high pressure)×0.5) and the highest compressor efficiency.

In Subject 5, the refrigerant is injected at the intermediate point of the interconnecting pipe. For this reason, when the refrigerant injection amount increases, the refrigerant compressed at the low-stage compression unit and the injected refrigerant are not mixed sufficiently such that part of the refrigerant is drawn into the high-stage compression unit in a liquid state. As a result, the compressor efficiency is adversely affected, and reliability is reduced.

(Subject 6: Prior Art Invention Method 2)

In Subject 6, the discharge port and the communication port are not close to the drive shaft, thereby increasing pressure losses. Subject 6 does not include a mechanism for absorbing pressure pulsations occurring in the low-stage discharge muffler space. In Subject 6, therefore, when the refrigerant injection amount was small, the compressor efficiency was lower compared to the prior art general method 2.

However, the injection refrigerant is injected into the low-stage discharge muffler space, so that the injection refrigerant is sufficiently mixed in the low-stage discharge muffler space. For this reason, the refrigerant in a liquid state is not drawn into the high-stage compression unit. As a result, when the refrigerant injection amount was large, the compressor efficiency was higher compared to the prior art general method 2.

(Subject 7: Configuration 3 of the First Embodiment)

In Subject 7, a circulation flow path for circulating the refrigerant was formed in the low-stage discharge muffler space 31. In Subject 7, the refrigerant was injected so as to join the circulation flow path. Thus, pressure losses and pressure pulsations were reduced and the compressor efficiency was enhanced compared to Subject 5.

(Subject 8: Configuration 4 of the First Embodiment)

In Subject 8, in addition to advantageous effects of Subject 7, guides are provided for facilitating the refrigerant to flow in from the discharge port 16, branch into an interconnecting flow path, and so on, so that the refrigerant flows along the circulation flow path. Thus, compared to Subjects 5, 6, and 7, pressure losses were greatly reduced, and the compressor efficiency was enhanced.

Based on the above experiment results, the two-stage compressor according to the first embodiment is capable of reducing pressure fluctuations and pressure losses occurring in the low-stage discharge muffler at a wide range of operating speed.

The two-stage compressor according to the first embodiment is likewise capable of reducing pressure fluctuations and pressure losses occurring in the low-stage discharge muffler when the refrigerant is injected.

Therefore, the compressor efficiency can be enhanced.

In the experiments described above, the R410A refrigerant was used. However, the two-stage compressor according to the first embodiment is likewise effective when using refrigerants other than the R410A refrigerant, such as HFC refrigerants (R22, R407, etc.), natural refrigerants such as HC refrigerants (isobutane, propane) and a CO2 refrigerant, and low-GWP refrigerants such as HFO1234yf.

In particular, the two-stage compressor according to the first embodiment provides greater effects with refrigerants operating at a low pressure, such as HC refrigerants (isobutane, propane), R22, and HFO1234yf.

Third Embodiment

In a third embodiment, the discharge port rear guide 41 of a combination type combining the discharge port rear guide 41 and the discharge port guiding guide 42 will be described.

Figure 10:
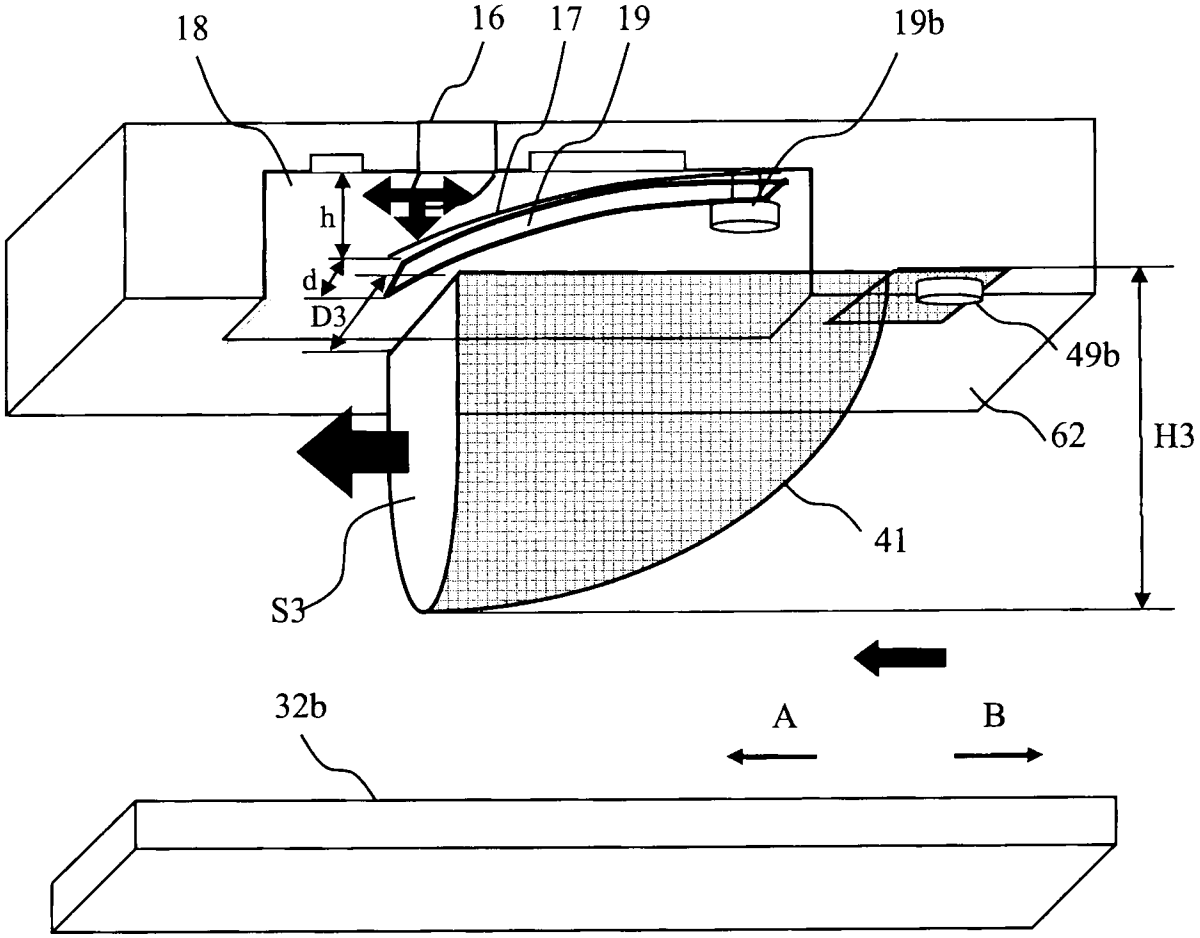
FIG. 10 is a diagram illustrating the discharge port rear guide 41 of a combination type according to a third embodiment.

FIG. 10 is a diagram illustrating the discharge port rear guide 41 of the combination type according to the third embodiment.

The discharge port rear guide 41 of the combination type shown in FIG. 10 is provided so as to cover the discharge port 16 from the rear side. The discharge port rear guide 41 of the combination type shown in FIG. 10 has an opening at the side of the flow path in the forward direction from the discharge port 16 to the communication port 34. That is, the discharge port rear guide 41 of the combination type shown in FIG. 10 is provided so as to cover the discharge port 16 from the rear side and also cover both of the sidewalls of the discharge port 16.

The discharge port rear guide 41 of the combination type is configured such that a concave portion is directed upstream of the forward flow direction, and a convex portion is directed downstream of the forward flow direction. Thus, at the discharge port rear guide 41, a resistance coefficient therein in the reverse direction is larger than a resistance coefficient in the forward direction. For example, when the discharge port rear guide 41 is formed in the shape of a hemispherical shell, the resistance coefficient in the reverse direction is approximately five times as large as the resistance coefficient in the forward direction.

A radial width D3 and a projected flow path area S3 (=D3×H3) of the opening of the discharge port rear guide 41 of the combination type provided to face the flow path in the forward direction are larger than the radial width d and the projected flow path area s (=d×h) of the stopper 19, respectively.

Figure 11:
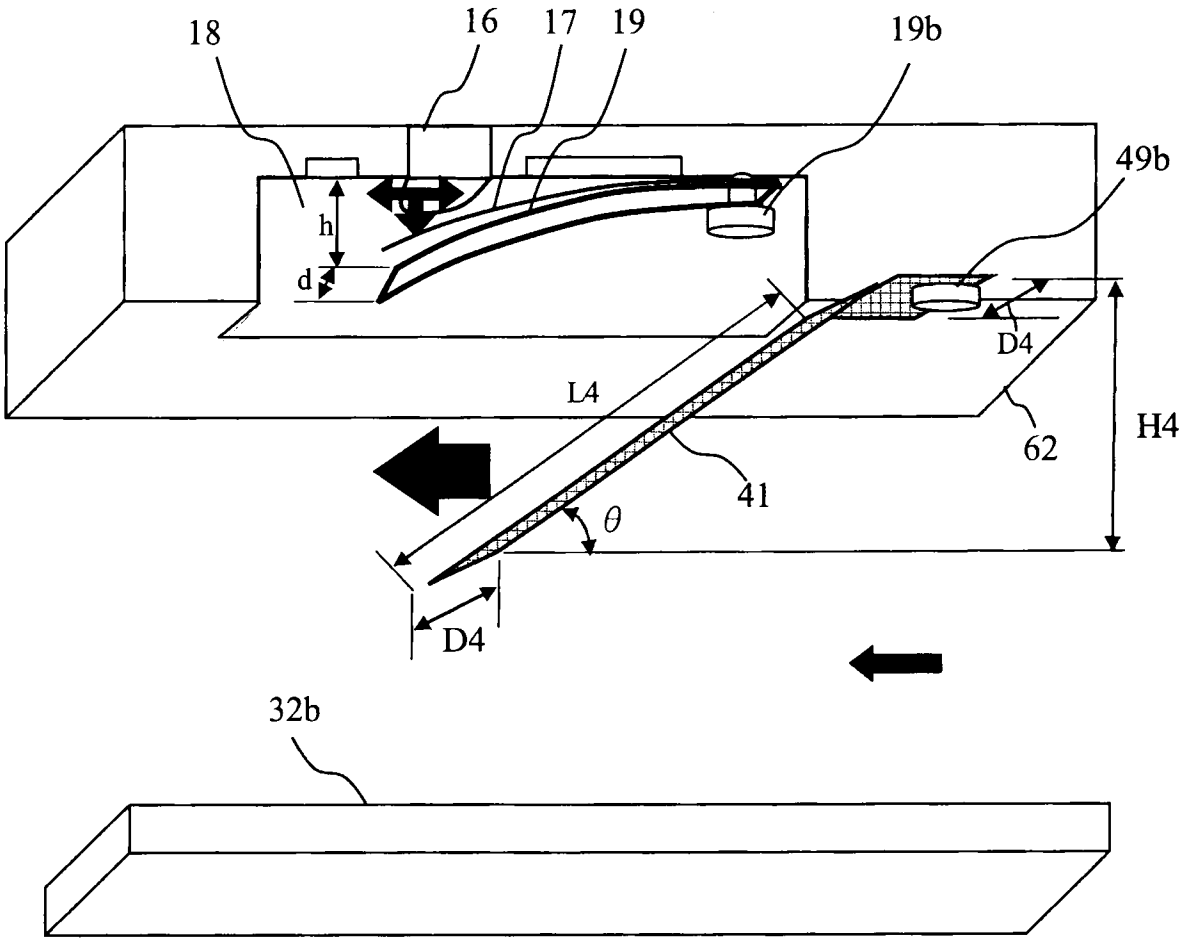
FIG. 11 is a diagram illustrating the discharge port rear guide 41 of the combination type according to the third embodiment.

FIG. 11 is a diagram illustrating another example of the discharge port rear guide 41 of the combination type according to the third embodiment.

The discharge port rear guide 41 of the combination type shown in FIG. 11 is formed in the shape of a plate, and is inclined toward the container bottom lid 32*b* so as to cover the discharge port 16 from the rear side.

A width D4, a height H4 (=L4×sin θ), and a projected flow path area S4 (=D4×H4) of the discharge port rear guide 41 of the combination type are larger than the radial width d, the height h, and the projected flow path area s (=d×h) of the stopper 19, respectively.

As a material for forming the discharge port rear guide 41 of the combination type shown in FIG. 10 or FIG. 11, it is desirable to use a perforated metal plate with a large number of perforations, such as perforated metal or metallic mesh, as with the discharge port rear guide 41 and the discharge port guiding guide 42. In this case, the projected flow path area S4 is obtained by an approximate expression "projected flow path area S4=D4×L4×(1−α)sin θ", taking account of a flow path open area rate a when the perforated metal plate is inclined.

The same effects as those obtained with the two-stage compressor according to the first embodiment can be obtained with a two-stage compressor including the discharge port rear guide 41 of the combination type shown in FIG. 10 or FIG. 11 in place of the discharge port rear guide 41 and the discharge port guiding guide 42.

Fourth Embodiment

In a fourth embodiment, descriptions will be directed to the low-stage discharge muffler space 31 in which some of the guides are formed by bolt fixing portions provided in the low-stage discharge muffler 30.

Figure 12:
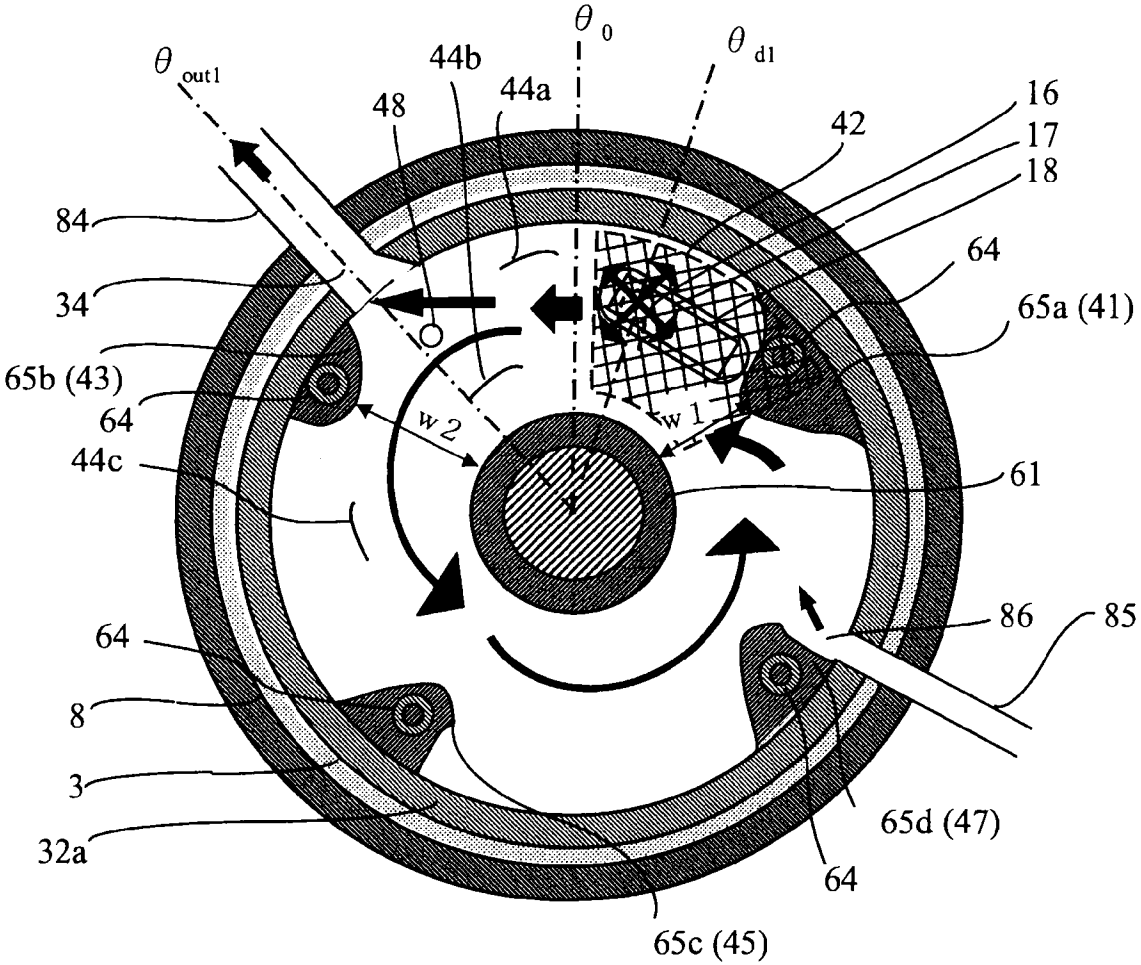
FIG. 12 is a diagram showing a low-stage discharge muffler space 31 according to a fourth embodiment.

FIG. 12 is a diagram showing the low-stage discharge muffler space 31 according to the fourth embodiment.

Figure 13:
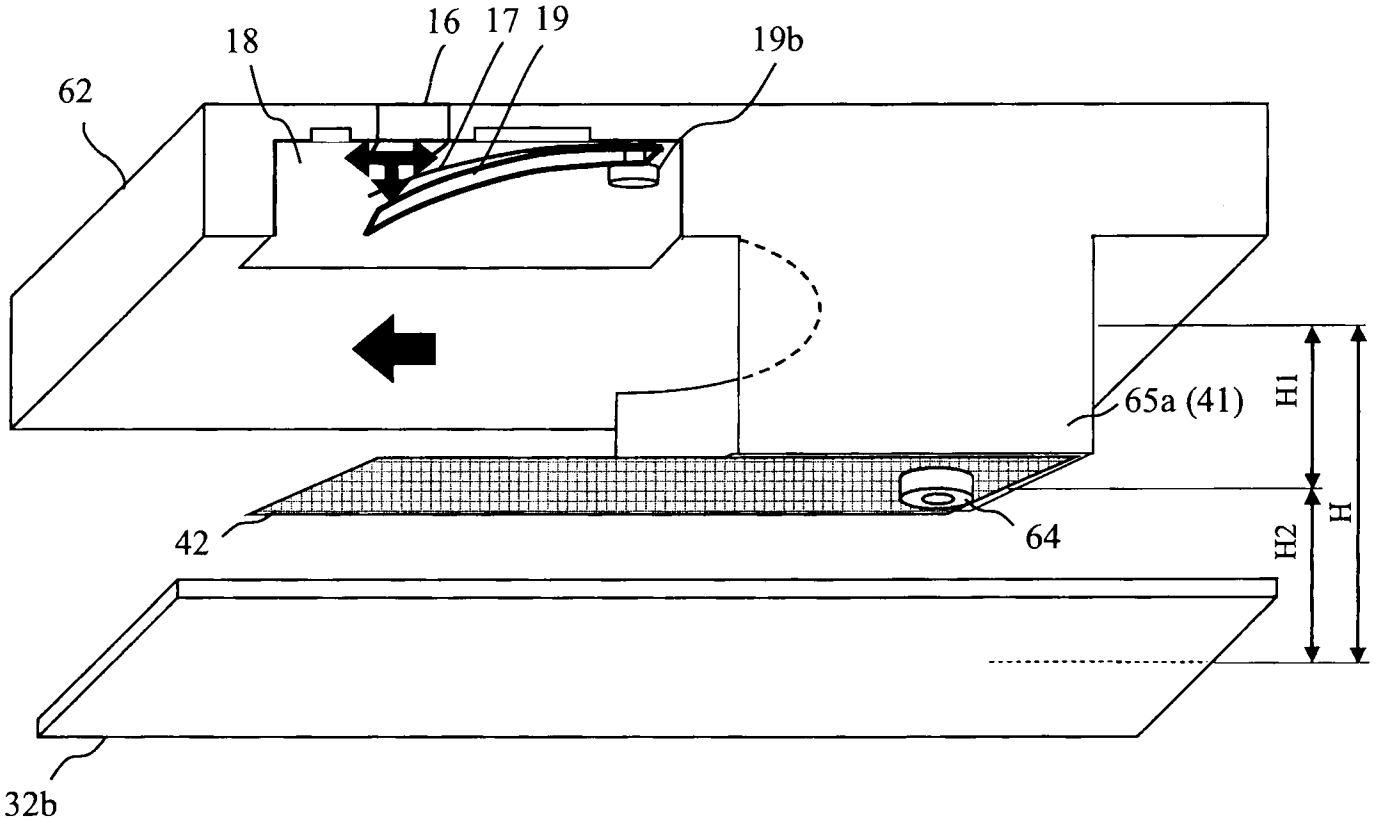
FIG. 13 is a diagram illustrating the discharge port rear guide 41 according to the fourth embodiment.

FIG. 13 is a diagram illustrating the discharge port rear guide 41 according to the fourth embodiment.

As to the low-stage discharge muffler space 31 shown in FIG. 12, only differences from the low-stage discharge muffler space 31 shown in FIG. 3 will be described.

In the low-stage discharge muffler 30 shown in FIG. 12 defining the low-stage discharge muffler space 31, bolt fixing portions 65*a*, 65*b*, 65*c*, and 65*d* are formed on the container outer wall 32*a*. The bolt fixing portions 65*a*, 65*b*, 65*c*, and 65*d* are formed by making the container outer wall 32*a* protrude toward the low-stage discharge muffler space 31. A total of four fastening bolts 64 are inserted into the bolt fixing portions 65*a*, 65*b*, 65*c*, and 65*d* so as to fasten the low-stage discharge muffler 30 with the lower support member 60.

In the low-stage discharge muffler space 31 according to the fourth embodiment, some of the guides described in the first embodiment are formed by forming the bolt fixing portions 65*a*, 65*b*, 65*c*, and 65*d* into predetermined protruded shapes and disposing them at predetermined positions.

In the low-stage discharge muffler space 31 shown in FIG. 12, the discharge port rear guide 41 is formed by the bolt fixing portion 65*a* located at the reverse direction side of the discharge valve accommodating recessed portion 18. The bolt fixing portion 65*a* is formed so as to cover the rear side of the discharge port 16 (the discharge valve accommodating recessed portion 18). The bolt fixing portion 65*a* blocks approximately half of a flow path width (a radial width of FIG. 12). A width of the flow path where the bolt fixing portion 65*a* is formed is defined as w1.

The flow control guide 43 is formed by the bolt fixing portion 65*b* located at the forward direction side of the communication port 34. The bolt fixing portion 65*b* blocks a narrower width of the flow path compared to the bolt fixing portion 65*a*. A width of the flow path where the bolt fixing portion 65*b* is formed is defined as w2 which is wider than w1. Accordingly, a flow path area where the bolt fixing portion 65*a* is formed is smaller than a flow path area where the bolt fixing portion 65*b* is formed.

The flow control guide 45 is formed by the bolt fixing portion 65*c*. The injection port guide 47 is formed by the bolt fixing portion 65*d*. The bolt fixing portions 65*b*, 65*c*, and 65*d* are formed by making the container outer wall 32*a* protrude into the low-stage discharge muffler space 31 such that the protruded portions are inclined to the forward direction. That is, the bolt fixing portions 65*b*, 65*c*, and 65*d* are positioned so as to induce a circular flow in the forward direction from the discharge port 16.

As shown in FIG. 13, the discharge port guiding guide 42 provided so as to cover the discharge port 16 is fixed to the bolt fixing portion 65*a* with the fastening bolt 64.

The bolt fixing portion 65*a* is formed only to a height H1 from the discharge-port-side wall 62. Accordingly, a flow path with a height H2 is secured between the bolt fixing portion 65*a* and the container bottom lid 32*b*. As a result, the refrigerant can also flow circularly at a portion where the bolt fixing portion 65*a* is provided by passing through the flow path with the height H2.

By using a metal plate with a large number of perforations as a material for forming the discharge port guiding guide 42, pressure pulsations of the refrigerant discharged from the discharge port 16 can be reduced.

As described above, with the two-stage compressor in which some of the guides are formed by the bolt fixing portions, the same effects can be obtained as those of the two-stage compressor according to the first embodiment.

Fifth Embodiment

In the two-stage compressor described in the first embodiment, part of the interconnecting flow path connecting the low-stage compression unit 10 and the high-stage compression unit 20 is formed by the interconnecting pipe 84 that passes outside of the closed shell 8. In a fifth embodiment, a two-stage compressor in which the interconnecting flow path passes inside of the closed shall 8 will be described.

Figure 14:
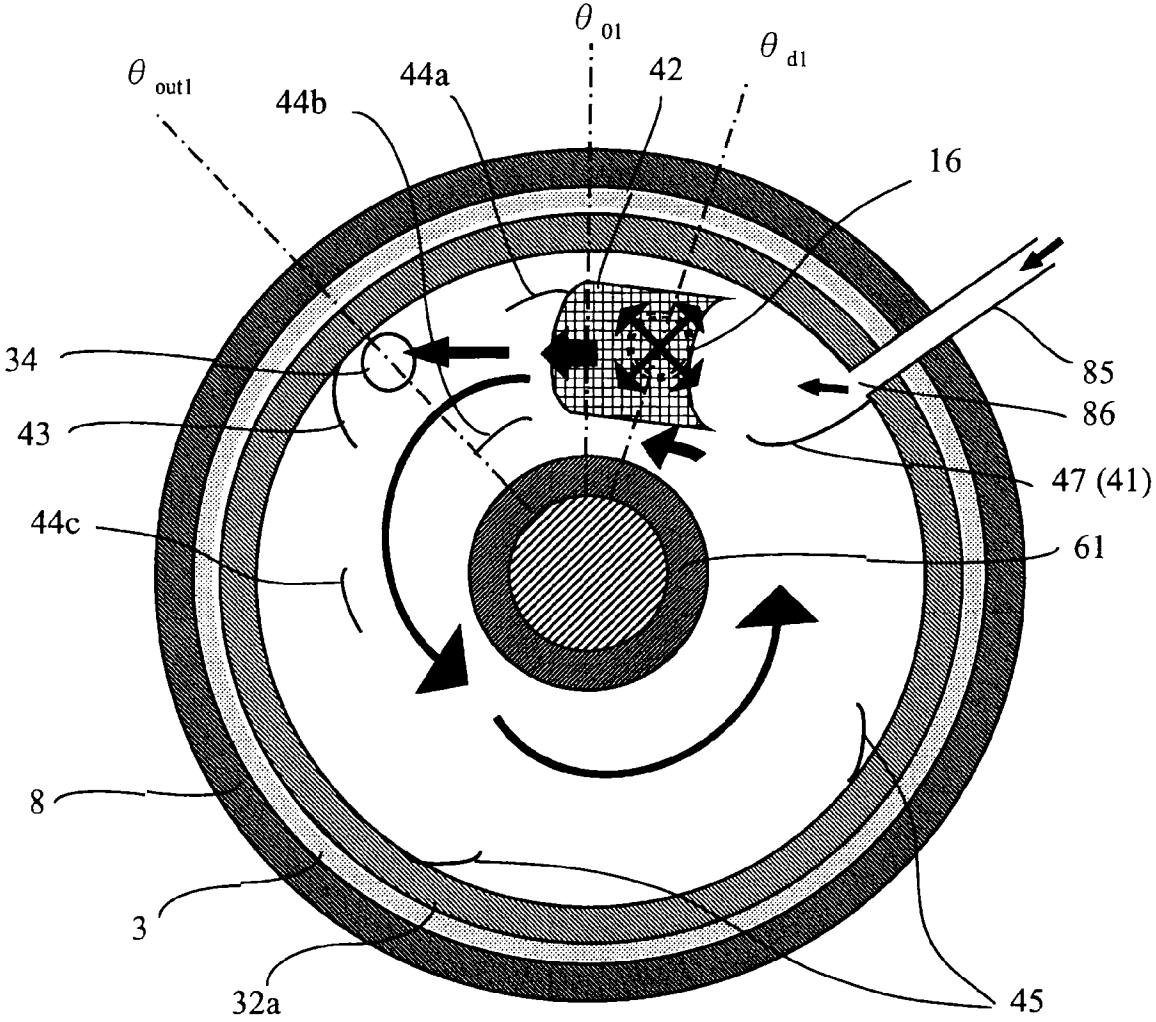
FIG. 14 is a diagram showing the low-stage discharge muffler space 31 according to a fifth embodiment.

FIG. 14 is a diagram showing the low-stage discharge muffler space 31 according to the fifth embodiment.

As to the low-stage discharge muffler space 31 shown in FIG. 14, only differences from the low-stage discharge muffler space 31 shown in FIG. 3 will be described.

In the low-stage discharge muffler space 31 shown in FIG. 14, the communication port 34 is provided in the discharge-port-side wall 62 of the lower support member 60. The interconnecting flow path that connects the communication port 34 of the low-stage discharge muffler space 31 and the cylinder suction port 25 of the high-stage compression unit 20 is formed internal to the closed shell 8 by passing through the low-stage cylinder 11 and the intermediate partition plate 5.

In the low-stage discharge muffler space 31 shown in FIG. 14, the flow control guide 43 protruded from the container outer wall 32*a* is provided so as to guard the communication port 34 at the forward direction side.

As described above, with the two-stage compressor in which the interconnecting flow path passes inside of the closed shell 8, the same effects can be obtained as those of the two-stage compressor according to the first embodiment.

In the low-stage discharge muffler space 31 shown in FIG. 14, the injection port 86 is provided closer to the rear side of the discharge port 16 compared to the low-stage discharge muffler space 31 shown in FIG. 3. Thus, the injection port guide 47 also serves as the discharge port rear guide 41.

That is, in the low-stage discharge muffler space 31 shown in FIG. 14, the injection port guide 47 induces the refrigerant injected from the injection port 86 to flow in the forward direction, and prevents the refrigerant discharged from the discharge port 16 from flowing in the reverse direction.

As described above, with the two-stage compressor in which the injection port 86 is provided in the proximity of the rear side of the discharge port 16 such that the injection port guide 47 also serves as the discharge port rear guide 41, the same effects can be obtained as those of the two-stage compressor according to the first embodiment.

Sixth Embodiment

In the first embodiment, in order to form the low-stage discharge muffler space 31 as a loop-like refrigerant circulation flow path, the discharge port rear guide 41 is formed such that the flow path in the reverse direction is partially partitioned to block the flow of the refrigerant. In a sixth embodiment, the discharge port rear guide 41 is formed such that the entire flow path in the reverse direction is partitioned to block the flow. That is, in the sixth embodiment, the low-stage discharge muffler space 31 forms, in appearance, a C-shaped refrigerant circulation flow path.

Figure 15:
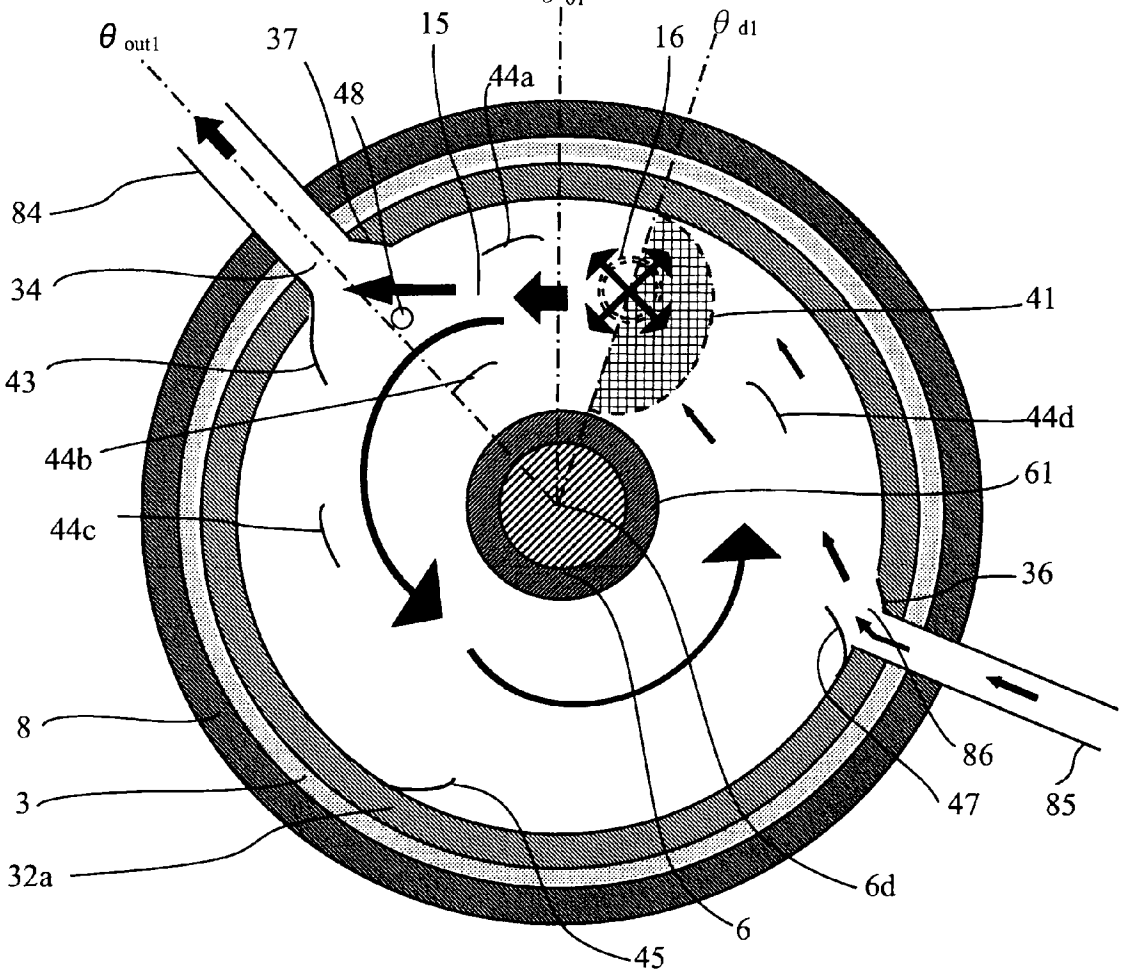
FIG. 15 is a diagram showing the low-stage discharge muffler space 31 according to a sixth embodiment.

FIG. 15 is a diagram showing the low-stage discharge muffler space 31 according to the sixth embodiment. As to the low-stage discharge muffler space 31 shown in FIG. 15, only differences from the low-stage discharge muffler space 31 shown in FIG. 3 will be described.

The discharge port rear guide 41 is formed so as to protrude from the rear side of the discharge port and cover the discharge port 16 from top and lateral directions. The discharge port rear guide 41 is of the combination type and also serves as the discharge port guiding guide 42. The discharge port rear guide 41 blocks the ring-shaped flow path at the rear side of the discharge port 16. However, the discharge port rear guide 41 is formed, for example, with a metal plate with a large number of perforations, such as perforated metal or metallic mesh, so that the refrigerant can flow through the holes. The discharge port rear guide 41 is formed with a metal plate with a large number of perforations, so that it is possible to reduce pressure pulsations of the refrigerant discharged from the discharge port 16, and to mix and guide the refrigerant discharged from the discharge port 16 with the refrigerant circulating in the low-stage discharge muffler space 31 and the refrigerant injected from the injection port 86.

As described above, in the two-stage compressor according to the sixth embodiment, pressure losses occurring when the refrigerant circulating in a loop in a fixed direction in the low-stage discharge muffler space 31 passes the discharge port rear guide 41 are greater compared to the first embodiment, thereby generating corresponding compressor losses. However, the refrigerant flows in the fixed direction from the low-stage discharge port, so that pressure losses can be reduced compared to prior art examples. Further, the refrigerant flows in a loop in the low-stage discharge muffler space 31 and a metal plate with a large number of perforations is used, so that pressure pulsations of the refrigerant can be reduced. Thus, with the two-stage compressor according to the sixth embodiment, it is possible to achieve enhancement of the compressor efficiency comparable to that achieved by the first embodiment.

Seventh Embodiment

Figure 16:
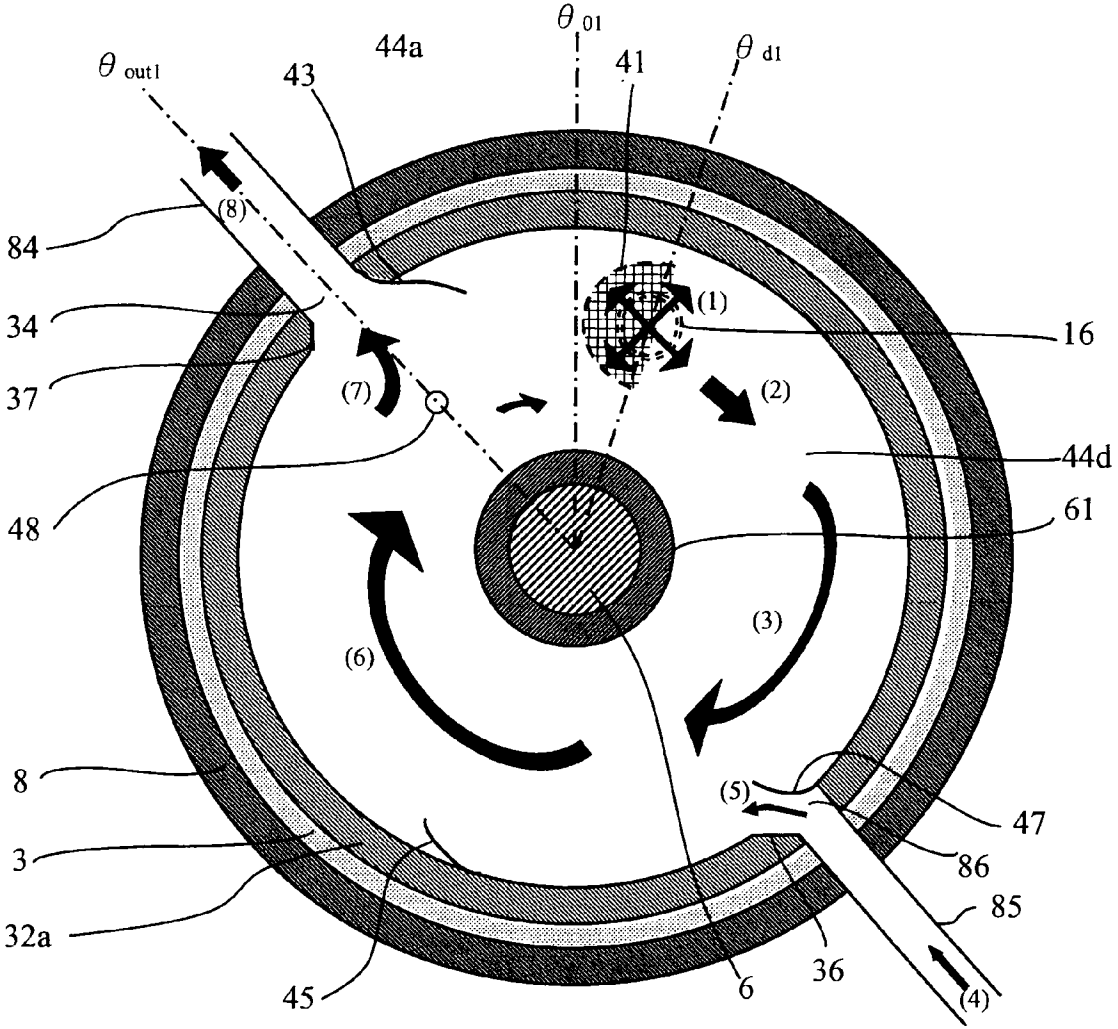
FIG. 16 is a diagram showing the low-stage discharge muffler space 31 according to a seventh embodiment.

FIG. 16 is a diagram showing the low-stage discharge muffler space 31 according to a seventh embodiment.

In the first embodiment, the discharge port rear guide 41 is provided at the flow path in the reverse direction having a longer flow path length out of the two flow paths from the discharge port 16 to the communication port 34 in different directions. Thus, an angle through which the refrigerant flowing from the discharge port 16 to the communication port 34 circulates from $\theta_{d1}$ to $\theta_{out1}$ is within 180 degrees. The seventh embodiment differs from the first embodiment in that the discharge port rear guide 41 is provided at the flow path in the forward direction having a shorter length out of the two flow paths from the discharge port 16 to the communication port 34 in different directions. Thus, in the seventh embodiment, the angle through which the refrigerant flowing from the discharge port 16 to the communication port 34 circulates from $\theta_{d1}$ to $\theta_{out1}$ is equal to or greater than 180 degrees.

Referring to FIG. 16, a flow in the low-stage discharge muffler space 31 will be described. The refrigerant discharged radially from the discharge port 16 ((1) of FIG. 16) is prevented from flowing in the forward direction by the discharge port rear guide 41 formed in a curved shape so as to cover the rear side of the discharge port, thereby being guided to flow in the reverse direction (clockwise) ((2), (3) of FIG. 16). When the refrigerant that has flowed through the injection pipe 85 ((4) of FIG. 16) is injected from the injection port 86, the refrigerant is prevented by the injection port guide 47 from flowing in the forward direction, thereby being guided to flow in the reverse direction (clockwise) ((5) of FIG. 3). Then, the refrigerant discharged from the discharge port 16 is mixed with the refrigerant injected from the injection port 86, and the mixed refrigerant circulates clockwise ((6) of FIG. 16). In the proximity of the communication port 34, the refrigerant branches into the discharge direction ((7) of FIG. 16) and the circulation direction. The wall 37 at the reverse direction side of the communication port 34 is tapered so that the refrigerant branched in the discharge direction is facilitated to flow into the interconnection pipe 84 through the communication port 34.

As described above, in the two-stage compressor according to the seventh embodiment, the angle through which the refrigerant flowing from the discharge port 16 to the communication port 34 circulates from $\theta_{d1}$ to $\theta_{out1}$ is equal to or greater than 180 degrees. As a result, pressure losses generated by a flow from the discharge port 16 to the communication port 34 are greater compared to the first embodiment, so that compressor losses are increased correspondingly.

However, in the two-stage compressor according to the seventh embodiment, the low-stage discharge muffler space 31 is formed in the shape of a ring and the refrigerant is made to circulate in a fixed direction, as with the first embodiment. With this arrangement, by circulating the refrigerant in the ring-shaped discharge muffler space, a difference between the timing of discharging the refrigerant by the low-stage compression unit and the timing of drawing in the refrigerant by the high-stage compression unit can be adjusted such that pressure pulsations can be turned into rotational motion energy instead of pressure losses. As a result, pressure pulsations can be reduced. Further, in the two-stage compressor according to the seventh embodiment, the refrigerant is induced to circulate in a fixed direction in the ring-shaped low-stage discharge muffler space 31, so that the refrigerant is facilitated to flow orderly, and pressure losses can be prevented. Thus, with the two-stage compressor according to the seventh embodiment, it is possible to achieve enhancement of the compressor efficiency comparable to that achieved by the first embodiment.

In the above embodiments, descriptions have been directed to the two-stage compressor of a rolling piston type. However, any compression method may be used as long as a two-stage compressor has a muffler space interconnecting a high-stage compression unit and a low-stage compression unit. The same effects can also be obtained with various types of two-stage compressor such as, for example, a sliding piston type and a sliding vane type.

In the above embodiments, descriptions have been directed to the two-stage compressor of a high-pressure shell type in which the pressure in the closed shell 8 is equal to the pressure in the high-stage compression unit 20. However, the same effects can be obtained with a two-stage compressor of either an intermediate pressure shell type or a low pressure shell type.

In the above embodiments, descriptions have been directed to the two-stage compressor in which the low-stage compression unit 10 is positioned below the high-stage compression unit 20 such that the refrigerant is discharged downwardly into the low-stage discharge muffler space 31. However, the same effects can be obtained with different positionings of the low-stage compression unit 10, the high-stage compression unit 20, and the low-stage discharge muffler 30 and a different direction of rotation of the drive shaft 6.

For example, the same effects can be obtained with a two-stage compressor in which the low-stage compression unit 10 is positioned above the high-stage compression unit 20 such that the refrigerant is discharged upwardly into the low-stage discharge muffler space 31.

The same effects can also be obtained when a two-stage compressor normally placed longitudinally is placed laterally.

In the above embodiments, descriptions have been given assuming that the discharge valve mechanism for opening the discharge port 16 is of the reed valve type that opens and closes by the elasticity of the thin plate-like valve and the difference in pressure between the low-stage compression unit 10 and the low-stage discharge muffler space 31. However, other types of discharge valve mechanism may be used. What is required is a check valve that opens and closes the discharge port 16 by using the difference in pressure between the low-stage compression unit 10 and the low-stage discharge muffler space 31 such as, for example, a poppet valve type used in a ventilation valve of a four-stroke cycle engine.

In the above embodiments, the low-stage discharge muffler 30 is provided with the injection port 86 so as to inject the refrigerant into the low-stage discharge muffler space 31. However, when the refrigerant is injected by connecting the injection pipe 85 to an interconnecting pipe provided external to the closed shell 8, the compressor efficiency can likewise be enhanced as shown by the experiment results of FIG. 9.

The above embodiments are summarized as follows.

The two-stage compressor according to the above embodiments includes, in the closed shell, the low-stage compression unit, the high-stage compression unit, the drive shaft and the motor for driving the two compression units, and the low-stage discharge muffler. The refrigerant at a low pressure is drawn into the low-stage cylinder chamber 11*a* of the low-stage compression unit, and is compressed to an intermediate pressure. Then, the low-stage discharge valve opens to discharge the refrigerant from the low-stage discharge port into the internal space of the low-stage discharge muffler, and the refrigerant is guided from the communication port to the interconnecting flow path. Then, the refrigerant at the intermediate pressure is drawn from the interconnecting flow path into the high-stage cylinder chamber 21*a* of the high-stage compression unit, is compressed to a high pressure, and is discharged external to the closed shell.

The internal space of the low-stage discharge muffler forms the loop-shaped refrigerant circulation flow path. The low-stage discharge port and the communication port are disposed as a junction port and a branch port. The flow control guide for preventing a flow in the reverse direction is provided at the rear or upper side of the low-stage discharge port such that a phase difference between the tangent direction of the ideal flow of the refrigerant circulation flow path and the shortest path direction from the low-stage discharge port to the communication port is within 90 degrees.

The two-stage compressor according to the above embodiments includes, in the closed shell, the low-stage compression unit, the high-stage compression unit, the drive shaft and the motor for driving the two compression units, and the low-stage discharge muffler, and the clearance in the closed shell not occupied by these components is filled with the refrigerant and lubricating oil. The refrigerant at a low pressure is drawn into the low-stage cylinder chamber 11*a* of the low-stage compression unit, and is compressed to an intermediate pressure. Then, the low-stage discharge valve opens to discharge the refrigerant from the low-stage discharge port into the internal space of the low-stage discharge muffler, and the refrigerant is guided from the communication port into an interconnecting flow path. Then, the refrigerant at the intermediate pressure is drawn from the interconnecting flow path into the high-stage cylinder chamber 21*a* of the high-stage compression unit, is compressed to a high pressure, and is discharged external to the closed shell.

The two-stage compressor is used for a two-stage compression injection cycle. The internal space of the low-stage discharge muffler space forms the loop-shaped refrigerant circulation flow path. The low-stage discharge port refrigerant, the injection port, and the communication port are disposed as junction and branch ports of the refrigerant circulation flow path. The flow guide is formed in the proximity of the injection port such that a phase difference between the tangent direction of the ideal flow of the refrigerant circulation flow path and the refrigerant injection direction at the injection port is within 90 degrees, so that the refrigerant discharged from the low-stage discharge port is mixed in the low-stage discharge muffler space.

The two-stage compressor according to the above embodiments further includes the flow guides for controlling a junction flow and a branch flow in the proximity of the junction port and the branch port of the refrigerant circulation flow path.

For the flow guides, a metal plate with a large number of openings, perforated metal, or metallic mesh is used.

The flow guides for controlling the junction flow and the branch flow in the proximity of the junction port and the branch port of the refrigerant circulation flow path are formed in the shape of a round bar.

Eighth Embodiment

In the first to seventh embodiments above, descriptions have been directed to the structures of the low-stage discharge muffler space 31 of the two-stage compressor in which two compression units are connected in series. In an eighth embodiment, descriptions will be directed to a structure of a lower discharge muffler of a single-stage twin compressor in which two compression units are connected in parallel.

In a prior art two-stage compressor, a difference between the timing of discharging a refrigerant by a low-stage compression unit and the timing of drawing in the refrigerant by a high-stage compression unit generates high pressure pulsations at an interconnecting portion. It is therefore extremely important to reduce intermediate pressure pulsation losses for enhancing the compressor efficiency.

On the other hand, in a prior art single-stage compressor, pressure pulsations as large as those generated in the interconnecting portion of the two-stage compressor are not generated. However, there is a lag between the phase of change in compression chamber volume and the phase of opening/closing of a valve. For this reason, pressure pulsations occur to no small degree in a discharge muffler. By reducing losses thus generated, the compressor efficiency can be enhanced.

In the eighth embodiment, a structure similar to the structures of the low-stage discharge muffler 30 of the two-stage compressor described in the first to seventh embodiment will be applied to a structure of a lower discharge muffler 130 of the single-stage twin compressor.

Figure 17:
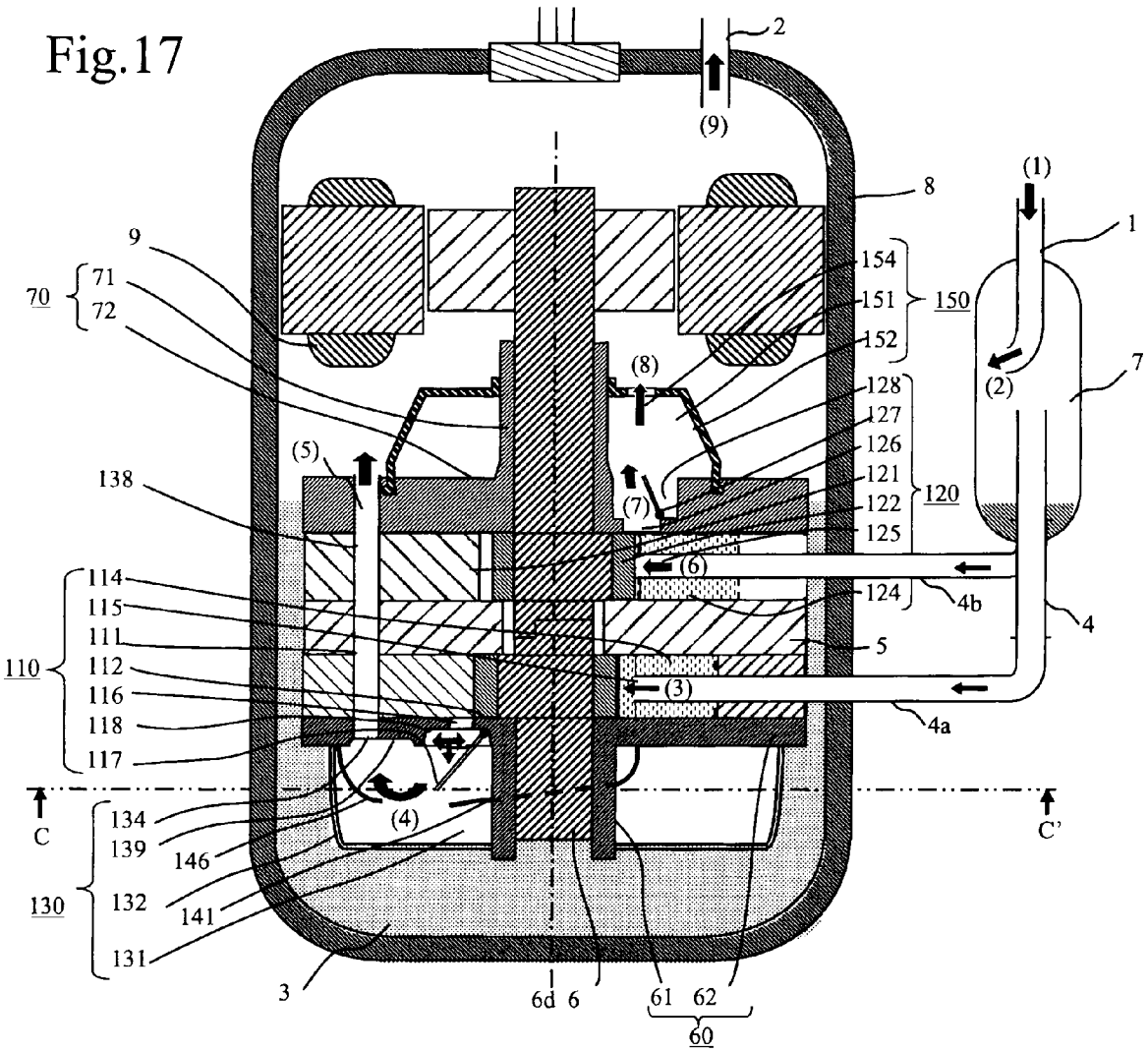
FIG. 17 is a cross-sectional view of an overall configuration of a two-stage compressor according to an eighth embodiment.

FIG. 17 is a cross-sectional view of an overall configuration of the single-stage twin compressor according to the eighth embodiment. Only differences from the two-stage compressor shown in FIG. 1 will be described.

The single-stage twin compressor according to the eighth embodiment includes, in the closed shell 8, a lower compression unit 110, an upper compression unit 120, the lower discharge muffler 130, and an upper discharge muffler 150, in place of the low-stage compression unit 10, the high-stage compression unit 20, the low-stage discharge muffler 30, and the high-stage discharge muffler 50 included in the two-stage compressor according to the first embodiment.

The lower compression unit 110, the upper compression unit 120, the lower discharge muffler 130, and the upper discharge muffler 150 are constructed substantially similarly to the low-stage compression unit 10, the high-stage compression unit 20, the low-stage discharge muffler 30, and the high-stage discharge muffler 50. Thus, descriptions will be omitted. However, the pressure in a lower discharge muffler space 131 is approximately the same as the pressure in the closed shell 8, so that a sealing portion for sealing the lower discharge muffler is not required, unlike the low-stage discharge muffler 30 of the first embodiment.

A communication port 134 is formed in the discharge-port-side wall 62 such that the refrigerant that has flowed into the lower discharge muffler space 131 flows out through the communication port 134. A lower discharge flow path 138 connected with the communication port 134 is formed through the discharge-port-side wall 62, the lower compression unit 110, the intermediate partition plate 5, the upper compression unit 120, and the discharge-port-side wall 72. The lower discharge flow path 138 is a flow path that guides the refrigerant discharged from the communication port 134 of the lower discharge muffler 130 into a space between the upper compression unit 120 and the motor unit 9 in the closed shell 8.

A flow of the refrigerant will be described.

First the refrigerant at a low pressure passes through the compressor suction pipe 1 ((1) of FIG. 17) and flows into the suction muffler 7 ((2) of FIG. 17). The refrigerant that has flowed into the suction muffler 7 is separated into the gas refrigerant and the liquid refrigerant in the suction muffler 7. At the suction muffler connecting pipe 4, the gas refrigerant branches into a suction muffler connecting pipe 4*a* and a suction muffler connecting pipe 4*b* to be drawn into the cylinder 111 of the lower compression unit 110 and a cylinder chamber 121*a* of the upper compression unit 120 ((3) (6) of FIG. 17).

The refrigerant drawn into a cylinder chamber 111*a* of the lower compression unit 110 and compressed to a discharge pressure at the lower compression unit 110 is discharged from a discharge port 116 into the lower discharge muffler space 131 ((4) of FIG. 17). The refrigerant discharged into the lower discharge muffler space 131 passes through the communication port 134 and the lower discharge flow path 138, and is guided into the space between the upper compression unit 120 and the motor unit 9 ((5) of FIG. 17).

The refrigerant drawn into the cylinder chamber 121*a* of the upper compression unit 120 and compressed to a discharge pressure at the upper compression unit 120 is discharged from a discharge port 126 into an upper discharge muffler space 151 ((7) of FIG. 17). The refrigerant discharged into the upper discharge muffler space 151 passes through a communication port 154, and is guided to the space between the motor unit 9 in the closed shell 8 ((8) of FIG. 17).

The refrigerant guided from the lower discharge muffler space 131 to the space between the upper compression unit 120 and the motor unit 9 ((5) of FIG. 17) is mixed with the refrigerant guided from the upper discharge muffler space 151 into the space between the upper compression unit 120 and the motor unit 9 ((8) of FIG. 17). Then, the mixed refrigerant passes through a clearance beside the motor unit 9 at the upper side of the compression unit, then passes through the compressor discharge pipe 2 fixed to the closed shell 8, and is discharged to the external refrigerant circuit ((9) of FIG. 17).

The lower discharge muffler 130 will be described.

Figure 18:
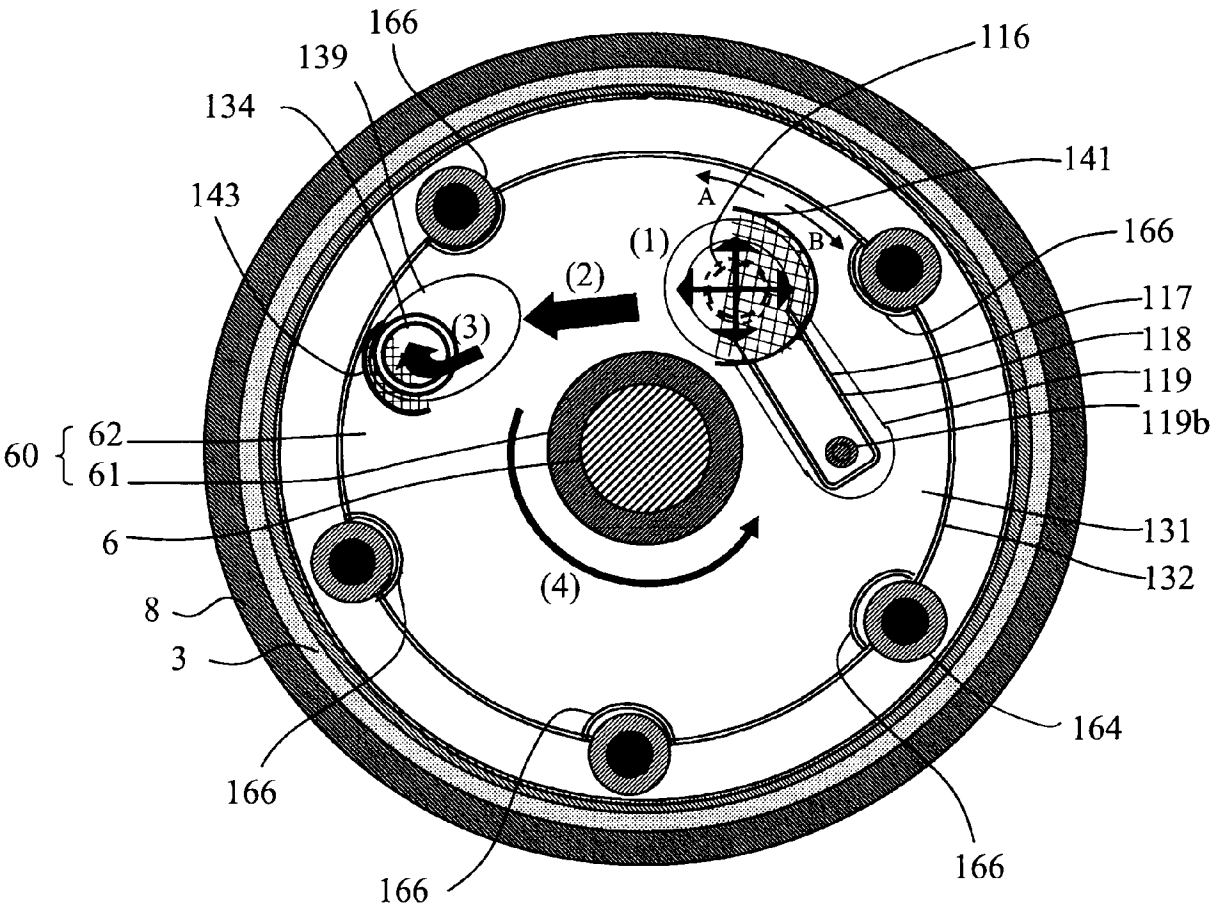
FIG. 18 is a cross-sectional view of the two-stage compressor according to the eighth embodiment taken along line C-C' of FIG. 16.

FIG. 18 is a cross-sectional view of the single-stage twin compressor according to the eighth embodiment taken along line C-C' of FIG. 17.

The lower discharge muffler space 131 is enclosed by a discharge muffler container 132 and the lower support member 60 having the lower bearing portion 61 and the discharge-port-side wall 62, and is formed so as to be connected circularly around the drive shaft 6.

As shown in FIG. 18, the lower discharge muffler space 131 is formed in the shape of a ring (doughnut) around the drive shaft 6 such that, at a cross-section perpendicular to the axial direction of the drive shaft 6, an inner peripheral wall is formed by the lower bearing portion 61 and an outer peripheral wall is formed by a container outer peripheral wall 132*a*. That is, the lower discharge muffler space 131 is formed in the shape of a ring (loop) around the drive shaft 6.

The discharge muffler container 132 is fixed to the lower support member 60 with five pieces of fastening bolts 164 evenly spaced apart. A bolt fixing portion 166 in which each bolt is disposed is formed by making the discharge muffler container 132 protrude into the ring-shaped flow path.

The refrigerant compressed at the lower compression unit 110 is discharged from the discharge port 116 into the lower discharge muffler space 131 ((1) of FIG. 18). The discharged refrigerant (i) circulates in the ring-shaped lower discharge muffler space 131 in the forward direction (direction A of FIG. 18) ((2), (4) of FIG. 18), and (ii) passes through the communication port 134 and the lower discharge flow path 138 and flows into the internal space of the closed shell 8 ((3) of FIG. 18).

In order to guide the refrigerant entering the lower discharge muffler space 131 to flow like (i) and (ii) above, a discharge port rear guide 141 of a combination type and a flow control guide 143 are provided in the lower discharge muffler space 131. In order to facilitate the refrigerant discharged from the discharge port 116 to flow into the communication port 134, a guide slot 139 is provided around the communication port 134.

The discharge port rear guide 141 of the combination type is the same as the discharge port rear guide 41 of the combination type shown in FIG. 10 described in the third embodiment.

Figure 19:
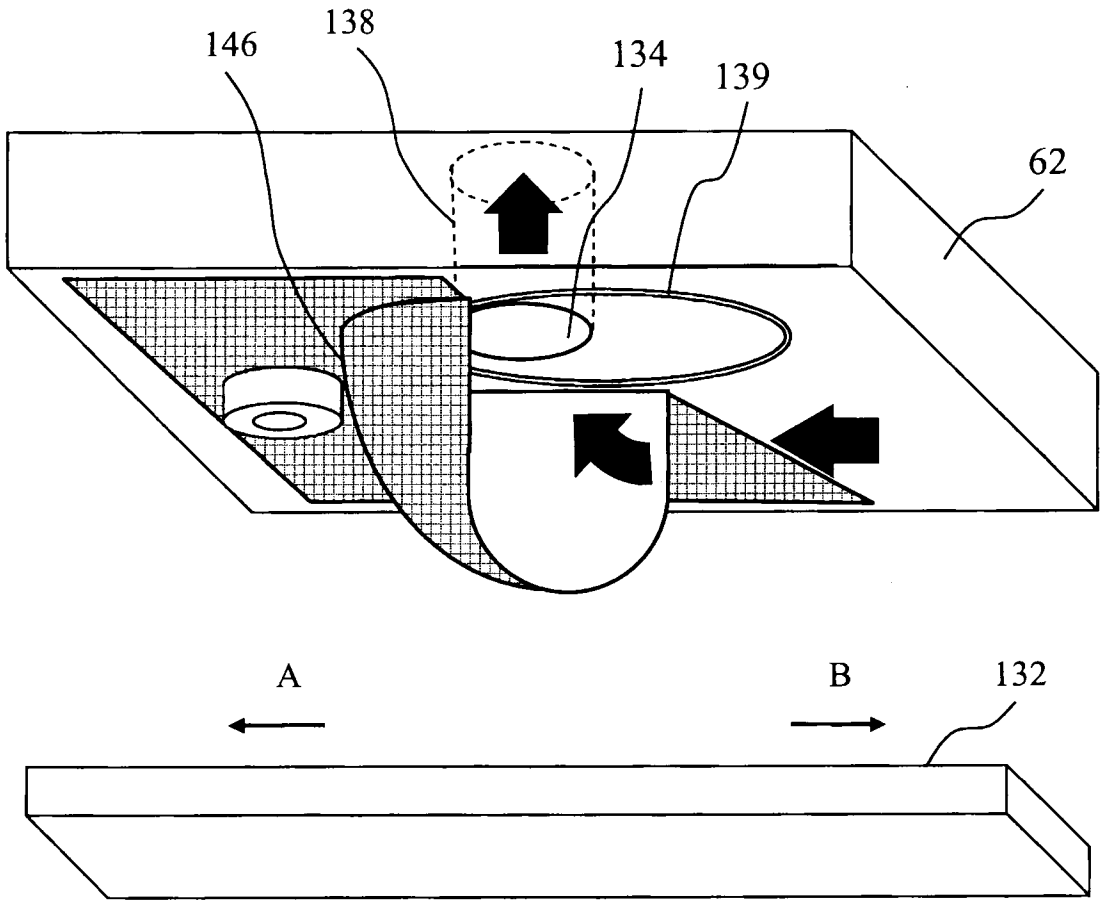
FIG. 19 is a diagram illustrating a flow control guide 143 according to the eighth embodiment.

Referring to FIGS. 18 and 19, the flow control guide 143 will be described.

FIG. 19 is a diagram illustrating the flow control guide 143 according to the eighth embodiment.

The flow control guide 143 formed in a concave curve is attached so as to cover a predetermined area around the opening of the communication port 134 formed in the discharge-port-side wall 62 of the lower support member 60. The flow control guide 143 is formed in a curve from the discharge-port-side wall 62 toward the low-stage discharge muffler space 131 gradually becoming nearly parallel with the discharge-port-side wall 62. The flow control guide 143 transforms a circulation flow in the forward direction in the discharge muffler space 131 into a flow in the direction of the lower discharge flow path 138 leading from the communication port 134 to the space between the upper compression unit 120 and the motor unit 9 in the closed shell 8.

As a material for forming the flow control guide 143, it is desirable to use a metal plate with a large number of perforations such as, for example, perforated metal or metallic mesh. By using a metal plate with a large number of perforations as a material for forming the flow control guide 143, it is possible to reduce pressure pulsations of the refrigerant discharged from the discharge port 116 and passing through the flow control guide 143.

The refrigerant discharged radially from the discharge port 116 is guided by the discharge port rear guide 141 of the combination type to flow in the forward direction in the ring-shaped lower discharge muffler space 131. Then, part of the refrigerant flowing in the forward direction in a substantially parallel direction (lateral direction of FIG. 17) is transformed into a flow in an upward axial direction (upward direction of FIG. 17) to pass through the communication port 134 and flow into the lower discharge flow path 138. At this time, the flow in the substantially parallel direction (lateral direction of FIG. 17) is smoothly transformed into the flow in the upward axial direction (upward direction of FIG. 17) by the flow control guide 143. The guide slot 139 is formed around the communication port 134, so that the refrigerant is facilitated to flow into the communication port 134.

The discharge port rear guide 141 of the combination type is wider and higher than the flow control guide 143. Accordingly, the discharge port rear guide 141 of the combination type blocks a larger portion of the ring-shaped flow path compared to the flow control guide 143. For this reason, the refrigerant discharged from the discharge port 116 is strongly prevented from flowing in the reverse direction and is guided to flow in the forward direction.

As described above, the compressor according to the eighth embodiment is capable of reducing pressure pulsations occurring in the refrigerant discharged from the compression unit and reducing pressure losses, as with the two-stage compressor according to the above embodiments. Thus, the compressor efficiency can be enhanced.

Ninth Embodiment

Figure 20:
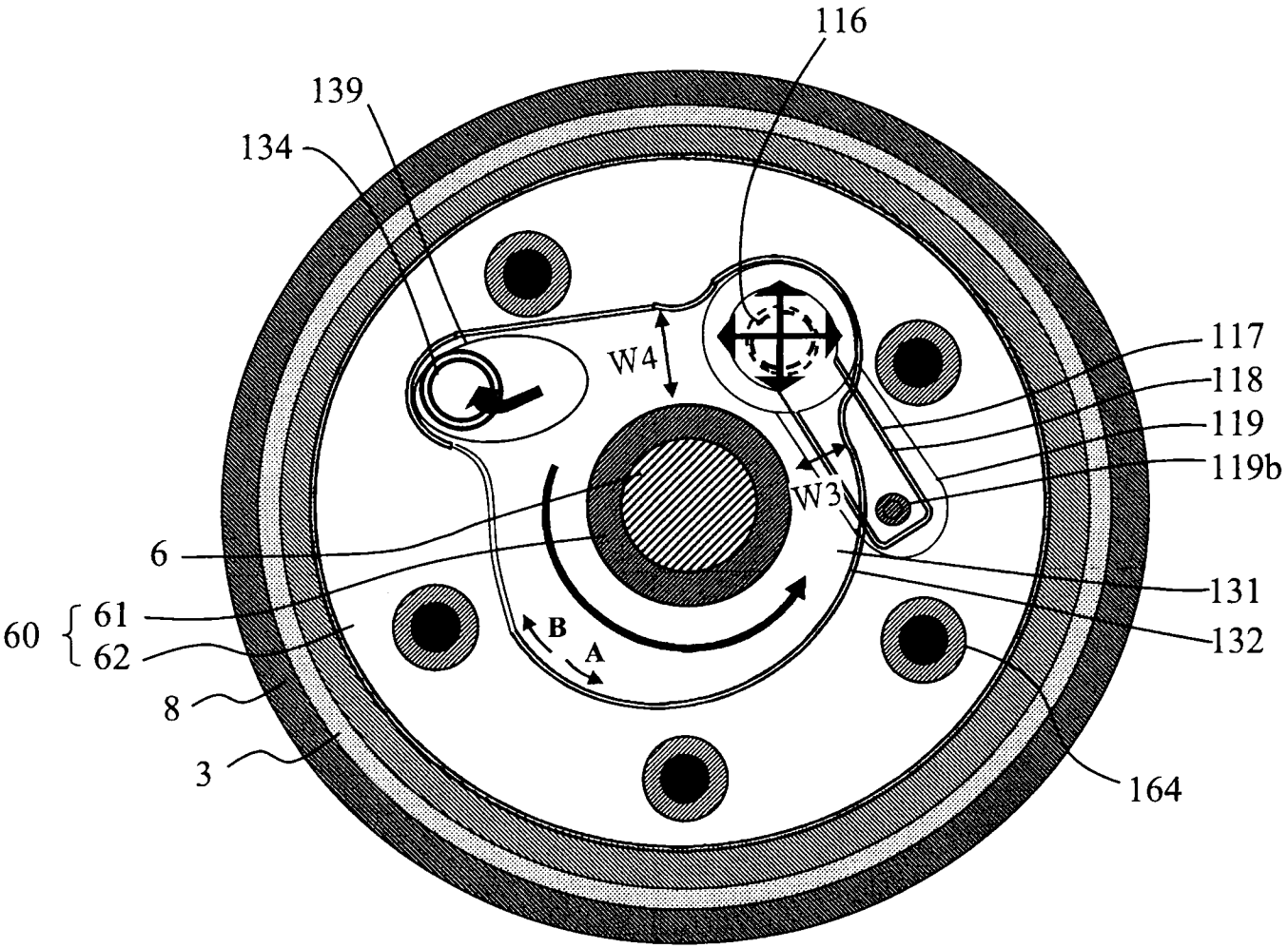
FIG. 20 is a diagram showing a lower discharge muffler space 131 according to a ninth embodiment.

FIG. 20 is a diagram showing the lower discharge muffler space 131 according to a ninth embodiment.

The discharge muffler container 132 shown in FIG. 18 is formed substantially symmetrically relative to the drive shaft 6 except for the bolt fixing portions. The discharge muffler container 132 according to the ninth embodiment shown in FIG. 20 is formed such that the circulation path is formed asymmetrically relative to the drive shaft 6.

In the discharge muffler container 132, a flow path width w3 (radial width of FIG. 20) at the rear side of the discharge port 116 is narrower than a minimum width w4 of a flow path in the forward direction out of two flow paths from the discharge port 116 to the communication port 134 in different directions around the shaft, i.e., the forward direction (direction A of FIG. 20) and the reverse direction (direction B of FIG. 20). That is, a flow path area at the rear side of the discharge port 116 is smaller than a minimum flow path area of the flow path in the forward direction from the discharge port 116 to the communication port 134. In the discharge muffler space 131 as described above, the refrigerant discharged from the discharge port 116 is facilitated to flow in the forward direction (direction A of FIG. 20) rather than in the reverse direction (direction B of FIG. 20).

Further, the discharge muffler container 132 is formed so as to cover the rear side of the discharge port 116, thereby functioning similarly to the discharge port rear guide 41 described in the first embodiment. As a result, the refrigerant discharged from the discharge port 116 is facilitated to flow in the forward direction (direction A).

As described above, the single-stage twin compressor according to the ninth embodiment can provide effects corresponding to the effects obtained by the rear discharge guide of the compressor according to the above embodiments, so that the amplitude of pressure pulsations occurring in the refrigerant discharged from the compression unit can be reduced, and pressure losses can be reduced. Then, the compressor efficiency can be enhanced as comparably with the above embodiments.

Tenth Embodiment

Figure 21:
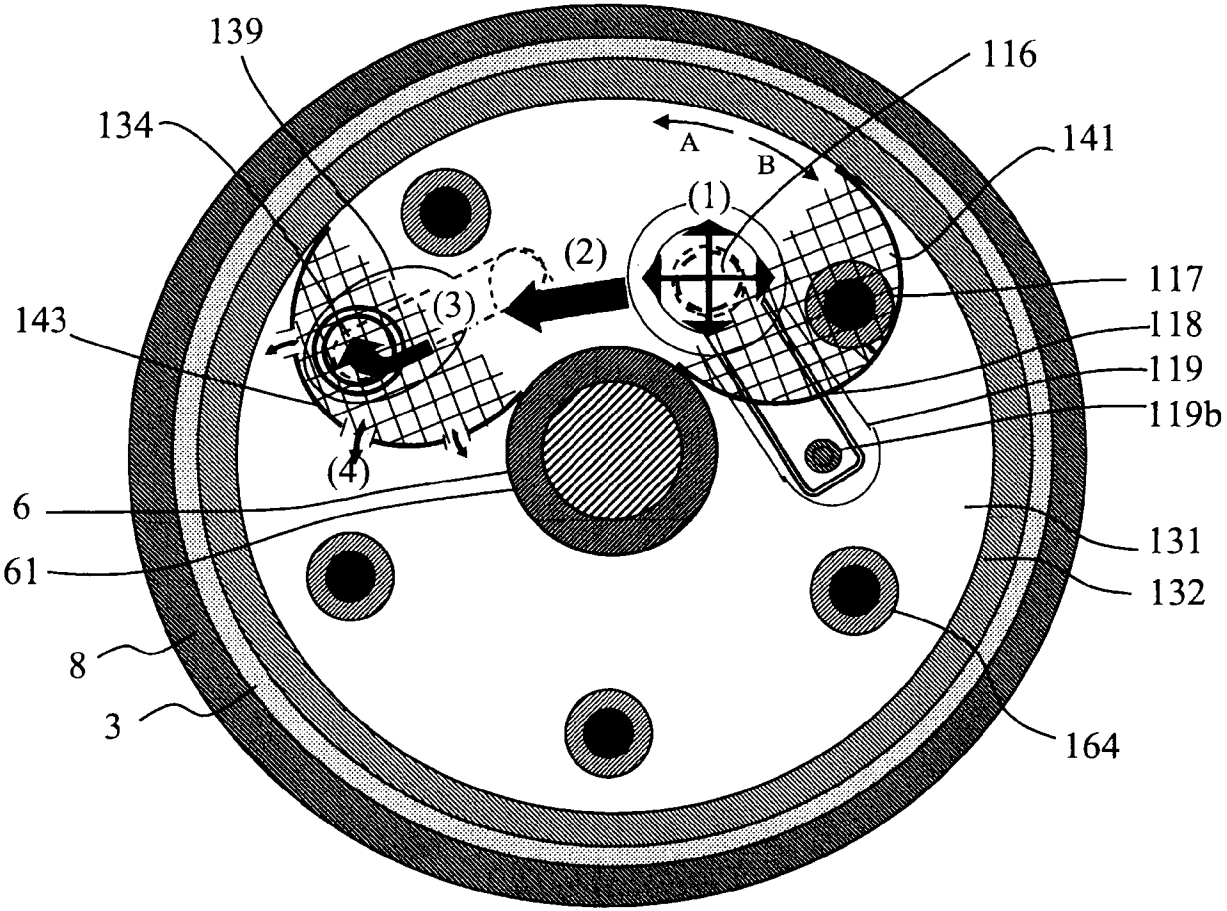
FIG. 21 is a diagram showing the lower discharge muffler space 131 according to a tenth embodiment.

FIG. 21 is a diagram showing the lower discharge muffler space 131 according to a tenth embodiment.

As shown in FIG. 21, the discharge port rear guide 141 is a metallic body having a plurality of perforations, and is provided around the discharge port 116 so as to divide the ring-shaped lower discharge muffler space 131 at the flow path in the reverse direction out of the two flow paths from the discharge port 116 to the communication port 134 in different directions around the shaft, i.e., the forward direction (direction A of FIG. 21) and the reverse direction (direction B of FIG. 21).

The flow control guide 143 is a metallic body having a plurality of perforations, and is disposed around the communication port 134 so as to divide the ring-shaped lower discharge muffler space 131 at the flow path in the reverse direction from the discharge port 116 to the communication port 134. The flow control guide 143 is disposed so as to cover a predetermined area of the opening of the communication port 134 from the reverse side to the communication port 134, as with the flow control guide 143 described in the eighth embodiment.

When open ratios of the discharge port rear guide 141 and the flow control guide 143 are compared, the open ratio of the flow control guide 143 is approximately three times as high as the open ratio of the discharge port rear guide 141. That is, a flow path area at the portion where the flow control guide 143 is provided is approximately three times as large as a flow path area at the portion where the discharge port rear guide 141 is provided.

Accordingly, the refrigerant discharged from the discharge port 116 is more strongly prevented from flowing in the reverse direction than flowing in the forward direction. Thus, a circular flow in the forward direction from the discharge port 116 to the communication port 134 is facilitated.

As described above, with the single-stage twin compressor according to the tenth embodiment, the amplitude of pressure pulsations occurring in the refrigerant discharged from the compression unit can be reduced and pressure losses can be reduced, as with the compressor according to the above embodiments. Thus, the compressor efficiency can be enhanced.

In the eighth to tenth embodiments, descriptions have been directed to the structures of the lower discharge muffler space of the single-stage twin compressor. However, the compressor efficiency can be likewise enhanced when a structure similar to the structures of the discharge muffler space described in the eighth to tenth embodiments is applied to the upper discharge muffler space of the single-stage twin compressor, the discharge muffler space of the single-stage twin compressor, or the high-stage discharge muffler space of the two-stage compressor. The compressor efficiency can be further enhanced when a structure similar to the structures of the discharge muffler space described in the eighth to tenth embodiments is applied to the low-stage discharge muffler space of the two-stage compressor.

A structure similar to the structures of the discharge muffler space described in the first to seventh embodiments may also be applied to the lower discharge muffler space of the single-stage twin compressor, the upper discharge muffler space of the single-stage twin compressor, or the high-stage discharge muffler space of the two-stage compressor.

Eleventh Embodiment

In an eleventh embodiment, a heat pump type heating and hot water system 200 will be described, as a usage example of the compressors described in the above embodiments. It is assumed that the two-stage compressor described in the first to seventh embodiments is used.

Figure 22:
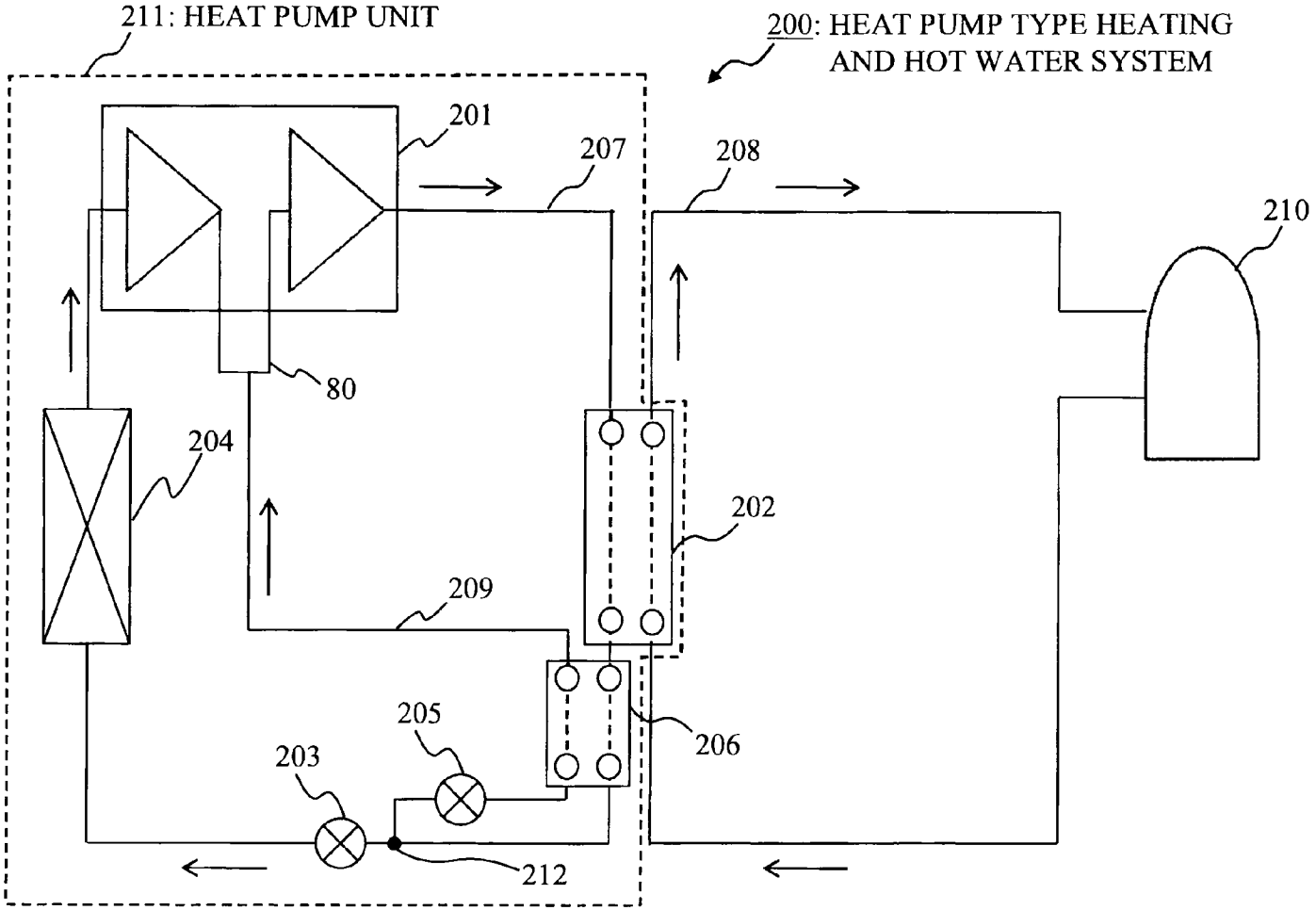
FIG. 22 is a schematic diagram of a configuration of a heat pump type heating and hot water system 200 according to an eleventh embodiment.

FIG. 22 is a schematic diagram showing a configuration of the heat pump type heating and hot water system 200 according to the eleventh embodiment. The heat pump type heating and hot water system 200 includes a compressor 201, a first heat exchanger 202, a first expansion valve 203, a second heat exchanger 204, a second expansion valve 205, a third heat exchanger 206, a main refrigerant circuit 207, a water circuit 208, an injection circuit 209, and a water using device 210 for heating and hot water supply. The compressor 201 is the multi-stage compressor (two-stage compressor) described in the above embodiments.

A heat pump unit 211 (heat pump apparatus) is comprised of the main refrigerant circuit 207 in which the compressor 201, the first heat exchanger 202, the first expansion valve 203, and the second heat exchanger 204 are connected sequentially, and the injection circuit 209 in which part of the refrigerant is diverted at a branch point 212 between the first heat exchanger 202 and the first expansion valve 203 such that the refrigerant flows through the second expansion valve 205 and the third heat exchanger 206 and returns to an interconnecting portion 80 of the compressor 201. The heat pump unit 211 operates as an efficient economizer cycle.

At the first heat exchanger 202, the refrigerant compressed by the compressor 201 is heat-exchanged with a liquid (water herein) flowing through the water circuit 208. The heat exchange at the first exchanger 202 cools the refrigerant and heats the water. The first expansion valve 203 expands the refrigerant heat-exchanged at the first heat exchanger 202. At the second heat exchanger 204, the refrigerant expanded according to control of the first expansion valve 203 is heat-exchanged with air. The heat exchange at the second heat exchanger 204 heats the refrigerant and cools the air. Then, the heated refrigerant is drawn into the compressor 201.

Further, part of the refrigerant heat-exchanged at the first heat exchanger 202 is diverted at the branch point 212 and is expanded at the second expansion valve 205. At the third heat exchanger 206, the refrigerant expanded according to control of the second expansion valve 205 is internally heat-exchanged with the refrigerant cooled at the first heat exchanger 202, and the refrigerant is then injected into the interconnecting portion 80 of the compressor 201. In this way, the heat pump unit 211 includes an economizer means for enhancing cooling and heating capabilities by a pressure-reducing effect of the refrigerant flowing through the injection circuit 209.

Referring now to the water circuit 208, the water is heated by the heat exchange at the first heat exchanger 202, and the heated water flows to the water using device 210 for heating and hot water supply and is used for hot water supply and heating, as described above. The water for hot water supply may not be the water heat-exchanged at the first heat exchanger 202. That is, the water flowing through the water circuit 208 may be further heat-exchanged with the water for hot water supply at a water heater or the like.

A refrigerant compressor according to this invention provides excellent compressor efficiency by itself. Further, by incorporating the refrigerant compressor into the heat pump type heating and hot water system 200 described in this embodiment and configuring an economizer cycle, a configuration suited for enhancing efficiency can be realized.

The foregoing description assumed the use of the two-stage compressor described in the first to seventh embodiments. However, a vapor compression type refrigerant cycle of a heat pump type heating and hot water system or the like may be configured by using the single-stage twin compressor described in the eighth to tenth embodiments.

The foregoing description concerned the heat pump type heating and hot water system (ATW (air to water) system) that heats water by the refrigerant compressed by the refrigerant compressor described in the above embodiments. However, the embodiments are not limited to this arrangement. It is also possible to form a vapor compression type refrigeration cycle in which a gas such as air is heated or cooled by the refrigerant compressed by the refrigerant compressor described in the above embodiments. That is, a refrigeration air conditioning system may be constructed with the refrigerant compressor described in the above embodiments. A refrigeration air conditioning system using the refrigerant compressor according to this invention is advantageous in enhancing efficiency.

REFERENCE SIGNS LIST

1: compressor suction pipe, 2: compressor discharge pipe, 3: lubricating oil storage unit, 4: suction muffler connecting pipe, 5: intermediate partition plate, 6: drive shaft, 7: suction muffler, 8: closed shell, 9: motor unit, 10: low-stage compression unit, 20: high-stage compression unit: 11, 12: cylinders, 11*a*, 21*a*: cylinder chambers, 12, 22: rolling pistons, 14, 24: vanes, 15, 25: cylinder suction ports; 16, 26: discharge ports, 17, 27: discharge valves, 18, 28: discharge valve accommodating recessed portions, 19: stopper, 19*b*: bolt, 30: low-stage discharge muffler, 31: low-stage discharge muffler space, 32: container, 32*a*: container outer wall, 32*b*: container bottom lid, 33: sealing portion, 34: communication port, 36: wall, 41: discharge port rear guide, 42: discharge port guiding guide, 43, 45: flow control guides, 44*a*, 44*b*, 44*c*, 44*d*: guiding guides, 47: injection port guide, 48: branch guide, 50: high-stage discharge muffler, 51: high-stage discharge muffler space, 52: container, 54: communication port, 58: high-stage discharge flow path, 60: lower support member, 61: lower bearing portion, 62: discharge-port-side wall, 63: outer wall, 64: fastening bolt, 65: bolt fixing portion, 70: upper support member, 71: upper bearing portion, 72: discharge-port-side wall, 80: interconnecting portion, 84: interconnecting pipe, 85: injection pipe, 86: injection port, 91: center position of the discharge port 16, 92: center position of the communication port 34, 93, 98: tangents, 94, 97: lines, 95, 99: angles, 96: center position of the injection port 86, 110: lower compression unit, 120: upper compression unit, 111, 121, cylinders, 111*a*, 121*a*: cylinder chambers, 112, 121; rolling pistons, 114, 124: vanes, 115, 125: cylinder suction ports, 116, 126; discharge ports, 117, 127: discharge valves, 118, 128: discharge valve accommodating recessed portions, 119: stopper, 119*b*: bolt, 130: lower discharge muffler, 131: lower discharge muffler space, 132: container, 132*a*: container outer wall, 132*b*: container bottom lid, 133: sealing portion, 134: communication port, 135: refrigerant circulation flow path, 136: wall, 138: lower discharge flow path, 144: guiding guide, 141: discharge port rear guide, 142: discharge port guiding guide, 143: flow control guide, 145: flow control guide, 148: branch guide, 150: upper discharge muffler, 151: upper discharge muffler space, 152: container, 154: communication port, 158: upper discharge flow path, 164: fastening bolt, 166: bolt fixing portion, 200: heat pump type heating and hot water system, 201: compressor, 202: first heat exchanger, 203: first expansion valve, 204: second heat exchanger, 205: second expansion valve, 206: third heat exchanger, 207: main refrigerant circuit, 208: water circuit, 209: injection circuit, 20: water using device for heating and hot water supply, 211: heat pump unit, 212: branch point

The invention claimed is:

1. A refrigerant compressor comprising:

a compression unit that is driven by rotation of a drive shaft passing through a center portion, the compression unit including a low-stage compression unit having a low-stage cylinder chamber that draws in and compresses a refrigerant, a high-stage compression unit having a high-stage cylinder chamber that draws in and further compresses the refrigerant compressed by the low-stage compression unit, and an interconnecting portion that connects the low-stage cylinder chamber and the high-stage cylinder chamber, the compression unit compressing the refrigerant in two stages such that a change in volume of the low-stage cylinder chamber discharging the refrigerant and a change in volume of the high-stage cylinder chamber drawing in the refrigerant are phase-shifted and a pressure pulsation loss is generated in the interconnecting portion;

a discharge muffler provided in the interconnecting portion and comprising a ring-shaped discharge muffler space surrounding the drive shaft, wherein the refrigerant compressed in the low-stage cylinder chamber flows into the ring-shaped discharge muffler space via a discharge port and circulates in a forward circumferential direction in the ring-shaped discharge muffler space to reach a communication port for the high-stage cylinder chamber; and a discharge port rear guide provided in the ring-shaped discharge muffler space and arranged to partially block a flow path circulation flow of the refrigerant to the communication port in a reverse circumferential direction that is circumferentially opposite a flow path in the forward circumferential direction, wherein the refrigerant is prevented from flowing in the reverse circumferential direction, so that the refrigerant circulates in the forward circumferential direction in the ring-shaped discharge muffler space and the pressure pulsation loss in the interconnecting portion is reduced.

2. The refrigerant compressor of claim 1, wherein the discharge port rear guide is positioned closer to the discharge port than to the communication port.

3. The refrigerant compressor of claim 1, wherein the discharge port rear guide is configured such that a pressure loss caused by the refrigerant flowing around the drive shaft, and caused by the discharge port rear guide, is smaller for the refrigerant flowing in the forward circumferential direction than in the reverse circumferential direction.

4. The refrigerant compressor of claim 1, wherein the discharge port rear guide is configured such that a fluid resistance to the flow of the refrigerant flowing around the drive shaft, caused by the discharge port rear guide, is smaller when the refrigerant flows in the forward circumferential direction than in the reverse circumferential direction.

5. The refrigerant compressor of claim 1, wherein the discharge port rear guide is configured as an object having a blunt side and a sharp side to a flow of the refrigerant, and is positioned relative to a flow circulating around the drive shaft in the ring-shaped discharge muffler space such that the sharp side is directed upstream of a flow in the forward circumferential direction and the blunt side is directed downstream of the flow in the forward circumferential direction.

6. A refrigerant compressor comprising:

a compression unit that is driven by rotation of a drive shaft passing through a center portion, the compression unit including a low-stage compression unit having a low-stage cylinder chamber that draws in and compresses a refrigerant, a high-stage compression unit having a high-stage cylinder chamber that draws in and further compresses the refrigerant compressed by the low-stage compression unit, and an interconnecting portion that connects the low-stage cylinder chamber and the high-stage cylinder chamber, the compression unit compressing the refrigerant in two stages such that a change in volume of the low-stage cylinder chamber discharging the refrigerant and a change in volume of the high-stage cylinder chamber drawing in the refrigerant are phase-shifted and a pressure pulsation loss is generated in the interconnecting portion;

a discharge muffler provided in the interconnecting portion and comprising a ring-shaped discharge muffler space surrounding the drive shaft, wherein the refrigerant compressed in the low-stage cylinder chamber flows into the ring-shaped discharge muffler space via a discharge port and circulates in a forward circumferential direction in the ring-shaped discharge muffler space, and the refrigerant that has circulated in the discharge muffler space flows in the forward circumferential direction to reach a communication port for the high-stage cylinder chamber; and a discharge port rear guide provided in the ring-shaped discharge muffler space and arranged to partially block a path of circulation flow of the refrigerant to the communication port in a reverse circumferential direction that is circumferentially opposite the forward circumferential direction, further comprising:

an opening/closing mechanism that opens and closes the discharge port by a pressure difference between a pressure of the refrigerant in the low-stage cylinder chamber of the compression unit and a pressure of the refrigerant in the discharge muffler space, wherein the discharge port rear guide is provided separately from the opening/closing mechanism, and wherein the opening/closing mechanism is provided at a recessed accommodating portion that opens into the discharge muffler space.

7. The refrigerant compressor of claim 6, wherein the opening/closing mechanism includes an on/off valve that is plate-like, and opens and closes the discharge port by being lifted toward the discharge muffler space by the pressure difference, and a stopper that is provided on a compression-unit-side face where the discharge port is formed, the stopper being inclined at a predetermined inclination angle toward the discharge muffler space and limiting a lift amount of the on-off valve, wherein the discharge port rear guide is inclined from the compression-unit-side face toward the discharge muffler space at an inclination angle which is closer to a right angle compared to the inclination angle of the stopper, and wherein an area of a figure obtained by rotating the discharge port rear guide with the drive shaft as a rotational axis and plotting a trajectory of the discharge port rear guide on a flat surface including the rotational shaft is greater than an area of a figure obtained by rotating the stopper with the drive shaft as the rotational axis and plotting a trajectory of the stopper on the flat surface.

8. The refrigerant compressor of claim 1, wherein in the circulation flow path in the ring-shaped discharge muffler space, a minimum flow path area of the circulation flow path in the reverse circumferential direction is smaller than a minimum flow path area of the circulation flow path in the forward circumferential direction.

9. The refrigerant compressor of claim 1, wherein the communication port and the discharge port are positioned such that at a cross-section perpendicular to an axial direction of the drive shaft for driving the compressor unit, an angle defined by a tangent at a center position of the discharge port to a circle centered on a center position of the drive shaft, passing the center position of the discharge port, and drawn over the flow path of the refrigerant in the forward circumferential direction, and by a line connecting a center position of the communication port and the center position of the discharge port, is not more than 90 degrees.

10. The refrigerant compressor of claim 1, further comprising:

a discharge port guiding guide being provided in the discharge muffler space so as to cover the discharge port and having formed therein an opening directed to the circulation flow path in the reverse circumferential direction and an opening directed to the circulation path in the forward circumferential direction, the discharge port guiding guide guiding the refrigerant discharged from the discharge port to flow in the forward circumferential direction.

11. The refrigerant compressor of claim 1, wherein the discharge port rear guide is formed by a bolt fixing portion for fixing a bolt for attaching another member to the discharge muffler, the bolt fixing portion being formed by part of the discharge muffler being protruded into the discharge muffler space.

12. A refrigerant compressor comprising:

a compression unit that is driven by rotation of a drive shaft passing through a center portion, the compression unit including a low-stage compression unit having a low-stage cylinder chamber that draws in and compresses a refrigerant, a high-stage compression unit having a high-stage cylinder chamber that draws in and further compresses the refrigerant compressed by the low-stage compression unit, and an interconnecting portion that connects the low-stage cylinder chamber and the high-stage cylinder chamber, the compression unit compressing the refrigerant in two stages such that a change in volume of the low-stage cylinder chamber discharging the refrigerant and a change in volume of the high-stage cylinder chamber drawing in the refrigerant are phase-shifted and a pressure pulsation loss is generated in the interconnecting portion;

a discharge muffler provided in the interconnecting portion and comprising a ring-shaped discharge muffler space surrounding the drive shaft, wherein the refrigerant compressed in the low-stage cylinder chamber flows into the ring-shaped discharge muffler space via a discharge port and circulates in a forward circumferential direction in the ring-shaped discharge muffler space, and the refrigerant that has circulated in the discharge muffler space flows in the forward circumferential direction to reach a communication port for the high-stage cylinder chamber; and a discharge port rear guide provided in the ring-shaped discharge muffler space and arranged to partially block a path of circulation flow of the refrigerant to the communication port in a reverse circumferential direction that is circumferentially opposite the forward circumferential direction, further comprising:

a branch guide that is rod-shaped and extends in the axial direction, the branch guide being positioned in the discharge muffler space between a position of the communication port and a center position of the discharge muffler space at the cross-section perpendicular to the axial direction of the drive shaft for driving the compression unit.

13. The refrigerant compressor of claim 1, further comprising:

a flow control guide that protrudes from an outer perimeter toward an inner perimeter of the discharge muffler space and is inclined in the forward circumferential direction around the drive shaft, the flow control guide preventing the refrigerant from flowing in the reverse circumferential direction around the drive shaft, wherein a fluid resistance caused by the flow control guide in a circulation flow of the refrigerant in the forward circumferential direction is smaller than a fluid resistance caused by the discharge port rear guide in a circulation flow of the refrigerant in the reverse circumferential direction.

14. The refrigerant compressor of claim 13, wherein the flow control guide covers a predetermined area of an opening portion of the communication port, and guides a flow in the forward circumferential direction around the drive shaft in the discharge muffler space so as to flow out from the communication port to the high-stage cylinder chamber.

15. A refrigerant compressor comprising:

a compression unit that is driven by rotation of a drive shaft passing through a center portion, the compression unit including a low-stage compression unit having a low-stage cylinder chamber that draws in and compresses a refrigerant and a high-stage compression unit having a high-stage cylinder chamber that draws in and further compresses the refrigerant compressed by the low-stage compression unit;

a discharge muffler that defines a ring-shaped discharge muffler space around the drive shaft into which the refrigerant compressed by the low-stage compression unit is discharged via a discharge port, from which the refrigerant discharged therein flows out to a different space via a communication port provided at a predetermined position, and in which is provided an injection port for injecting an injection refrigerant, the ring-shaped discharge muffler space being defined at one side in an axial direction of the drive shaft relative to the low-stage cylinder chamber included in the low-stage compression unit; and an injection port guide that is positioned closer to the injection port than to the communication port in one of circulation flow paths in two different circumferential directions around the drive shaft, namely a forward circumferential direction and a reverse circumferential direction, flowing from the injection port to the communication port in the ring-shaped discharge muffler space defined by the discharge muffler, the injection port guide being positioned closer to the injection port than to the communication port in the circulation flow path in the reverse circumferential direction, wherein the injection port guide is arranged to prevent the refrigerant from flowing in the reverse circumferential direction, so that the refrigerant flows in the forward circumferential direction in the ring-shaped discharge muffler space.

16. The refrigerant compressor of claim 15, wherein the injection port guide is configured such that a pressure loss in the refrigerant caused by the injection port guide is smaller when the refrigerant flows in the forward circumferential direction than in the reverse circumferential direction.

17. The refrigerant compressor of claim 15, wherein the injection port guide covers a predetermined area of an opening portion of the injection port and is inclined away from the injection port from a side of the flow path in the reverse circumferential direction toward the flow path in the forward circumferential direction.

18. The refrigerant compressor of claim 15, wherein the injection port guide is formed by part of the discharge muffler being protruded into the discharge muffler space.

19. The refrigerant compressor of claim 1, further comprising:

a flow control guide that is positioned at a downstream portion of a circulation flow of the refrigerant in the forward circumferential direction relative to the communication port such that the flow control guide protrudes from an outer perimeter toward an inner perimeter of the discharge muffler space and is inclined in the forward circumferential direction, the flow control guide preventing the refrigerant from flowing in the reverse circumferential direction around the drive shaft and guiding the refrigerant to the communication port, wherein a fluid resistance caused by the flow control guide in a circulation flow of the refrigerant in the forward circumferential direction is smaller than a fluid resistance caused by the discharge port rear guide in a circulation flow of the refrigerant in the reverse circumferential direction.

20. A heat pump apparatus comprising:

a refrigerant circuit in which the refrigerant compressor of claim 1, a radiator, an expansion mechanism, and an evaporator are sequentially connected with pipes.

21. A heat pump apparatus comprising:

a refrigerant circuit in which the refrigerant compressor of claim 15, a radiator, an expansion mechanism, and an evaporator are sequentially connected with pipes.

22. The refrigerant compressor of claim 1, wherein the flow path from the discharge port to the communication port in the forward circumferential direction is shorter than the flow path from the discharge port to the communication port in the reverse circumferential direction.

* * * * *